US011712617B2

(12) United States Patent
Gastel

(10) Patent No.: US 11,712,617 B2
(45) Date of Patent: Aug. 1, 2023

(54) ICE SKATING RINK STRUCTURE AND METHOD

(71) Applicant: Dylan Gastel, Boston, MA (US)

(72) Inventor: Dylan Gastel, Boston, MA (US)

( * ) Notice: Subject to any disclaimer, the term of this patent is extended or adjusted under 35 U.S.C. 154(b) by 1059 days.

(21) Appl. No.: 16/313,606

(22) PCT Filed: Jun. 30, 2017

(86) PCT No.: PCT/US2017/040419
§ 371 (c)(1),
(2) Date: Dec. 27, 2018

(87) PCT Pub. No.: WO2018/006036
PCT Pub. Date: Jan. 4, 2018

(65) Prior Publication Data

US 2020/0179792 A1 Jun. 11, 2020

Related U.S. Application Data

(60) Provisional application No. 62/356,842, filed on Jun. 30, 2016.

(51) Int. Cl.
*A63C 19/10* (2006.01)
*E01C 13/10* (2006.01)

(52) U.S. Cl.
CPC ..... *A63C 19/10* (2013.01); *E01C 13/102* (2013.01); *A63C 2203/10* (2013.01)

(58) Field of Classification Search
CPC ..... A63C 19/00; A63C 19/10; A63B 71/02
USPC ..... 472/89–90; 62/235
See application file for complete search history.

(56) References Cited

U.S. PATENT DOCUMENTS

| | | | | |
|---|---|---|---|---|
| 3,771,891 | A | 11/1973 | Nirenski et al. | |
| 3,930,647 | A | 1/1976 | Berlemont | |
| 4,392,647 | A | 7/1983 | Golebieski | |
| 5,134,857 | A * | 8/1992 | Burley | A63C 19/12 62/235 |
| 5,820,470 | A | 10/1998 | Saunders | |
| 6,230,451 | B1 | 5/2001 | Stoller | |

OTHER PUBLICATIONS

International search report for corresponding PCT/US2017/040419 dated Sep. 26, 2017.

* cited by examiner

*Primary Examiner* — Kien T Nguyen
(74) *Attorney, Agent, or Firm* — Robinson & Cole LLP

(57) ABSTRACT

A self-standing portable ice skating rink structure that does not penetrate the underlying surface and generally requires no tools or hardware for installation is provided. The ice skating rink structure includes a perimeter component and one or more tension members. The perimeter component can include one or more board holding members and/or one or more optionally interlocking side boards.

106 Claims, 15 Drawing Sheets

ICE SKATING RINK STRUCTURE AND METHOD

RELATED APPLICATION

This application claims priority to PCT Application PCT/US2017/040419 filed on Jun. 30, 2017, which in turn claims priority to U.S. Provisional Patent Application Ser. No. 62/356,842 filed on Jun. 30, 2016, the disclosures of which are incorporated by reference herein in their entirety.

TECHNICAL FIELD

A self-standing portable ice skating rink structure that does not penetrate the underlying surface and generally requires no tools or hardware for installation is provided. The ice skating rink structure comprises a combination of some or all of one or more side boards, one or more board holding members, one or more tension members and an impermeable liner. In one embodiment, a perimeter component is fitted with a water-filled impermeable liner and the perimeter component is held together by one or more tension members, such as straps with interlocking snaps or buckles. Each of the board holding members stand on the ground and can comprise a U-shaped slot or receptacle area for holding at least one board and can have at least one area for an aperture or receptacle for which to attach a tension member. The boards can also have one or more receptacles for tension members or board holding members. The tension members traverse the area of the enclosed rink and attach to board holding members or boards on opposite sides of the rink. The boards can comprise the perimeter of the ice skating rink structure. A plurality of interconnecting boards can also comprise the perimeter component. Alternatively, a plurality of interconnecting boards can be further connected with one or more corner connecting components or corner connectors to comprise the perimeter component. An alternative embodiment has boards and board holding members which are combined into one piece. A liner is placed over the tension members, up the walls of the boards, and covers the area of the rink. Into this liner water is poured, which freezes into ice by way of the temperature of the surrounding air or an optional refrigeration system placed under or inside the rink. Boards of different heights can be used for rinks built on unlevel ground. Because no component of the rink penetrates the surface under the rink, the rink can be installed on many different types of surfaces including, but not limited to, hard courts, parking lots, and frozen or unfrozen ground. If installed on a slope, optional spikes can be inserted into optional holes or receptacles in the board holding members.

BACKGROUND

Ice hockey and ice skating in general are increasingly popular in cold climates. The demand for ice time is so high compared with supply in many regions that teams and other clubs/groups must rent ice time during very early morning hours or very late nighttime hours. Many programs, especially those run by public high schools have been forced to reduce practice ice time hours or even eliminate entire programs due to increased costs to obtain ice time, particularly in view of reduced budgets.

Traditionally, hockey players and other skaters have used frozen lakes or ponds on which to skate during the winter months. In addition, families, towns and other associations have flooded fields or parking lots to form ice on which to skate. Skating on lakes and ponds can be extremely dangerous. Also, flooding a permeable field or lot is not feasible in regions where the ice will melt and then refreeze throughout the winter, as the water will drain once the ice intermittently melts.

There are presently many complicated methods for constructing an outdoor ice rink. These usually involve constructing some sort of perimeter inside of which an impermeable liner is optionally laid. This open-top container is then partially filled with water, which freezes into ice in the rough shape of an ice rink. These perimeters are usually constructed of some combination of plywood, lumber, spikes, stakes, screws and nails. The impermeable liners according to the prior art must be precisely custom made for each perimeter size and shape. Any damage to the liner, desired modification to the shape and/or size of the perimeter, or any manufacturing imperfections would render the liner unusable, wasting the material and requiring an entirely new liner.

There also exist some manufactured components made of plastic or metal that somewhat simplify the process. However, these systems either penetrate the ground and/or require hardware, sand bags, or some sort of hand-held or power tools to construct. There also exist inflatable structures, however these do not offer a solid board off which to bounce a puck, can be punctured by a skate, and are not modular or easily customizable.

Driving any sort of spike or stake into the ground requires immense force. When the ground is frozen or partially frozen, this can become virtually impossible for the average person. In addition, many people do not have the strength or experience with which to effectively hammer the stake or spike into unfrozen or frozen earth. The use of other tools and power tools—including but not limited to saws, hammers, drills, and screwdrivers—pose similar challengers to landowners who wish to install a rink on their property.

When the best space to install a rink covers wholly or partially a surface that cannot have spikes or stakes driven into it without damage, (i.e. tennis or sport courts, turf fields, parking lots), current methods and products cannot be used. In these cases, heavy sandbags or complicated reinforcements made of lumber are generally required to support the board holding members and/or boards. However, these designs are either too complicated, labor intensive, and/or expensive for the average person to handle or require the inconvenient lifting of many sandbags or other weights, or even specialized equipment such as drills, hammers and/or lumber. Rink designs that penetrate the ground also pose threats to expensive underground systems such as underground utilities and sprinkler systems.

It is apparent from the above that there is a need for providing a portable, free-standing skating rink that can be constructed, i.e. installed, easily on most surfaces without the need for additional tools or hardware, and that does not require penetration of the ground to secure the system.

SUMMARY

In accordance with the present invention, an ice skating rink structure is provided, comprising a combination of some or all of one or more side boards, one or more board holding members, one or more tension members, and an impermeable liner. Neither the board holding members nor the structure have members which insert or penetrate into the ground and the structure lies relatively flat on the ground. The board holding members comprise a slot, groove or other receptacle member, preferably U-shaped or squared off U-shaped, to hold the boards, generally in a vertical position. Tension members can then be used to attach to the board holding members or boards to traverse the rink to restrain the board holding members and boards from sliding or tipping from the force of the water and/or ice.

In one embodiment, the board holding members used to support the boards and attach to the board holding members are generally triangular in shape, have a U-shaped or squared-off U-shaped receptacle member to hold the boards, and an aperture or loop, hole or other member at which to attach the tension member. The board holding members or boards can also include a mechanical, magnetic or other member which is used to secure the top/edge of the impermeable liner. The board holding member has no downward projections and can sit relatively flat on any relatively flat surface. The supporting bracket or board holding member that holds the boards requires no tools or fasteners to hold the board(s) that it supports. The boards are provided in a variety of dimension, and in some embodiments are about 5 feet in length, and about 0.5 to 4 inches wide, and 6 inches to about 2 feet or greater in height.

In one embodiment, the board holding members include a base having no downward projections or spikes that would need to be driven into the ground. A support buttress or brace, optionally forming a hypotenuse of a triangular member, can be used to strengthen the board holding member that holds the board(s). Optionally, there also can be a hole or slot in the board holding member in which a rod, stake, spike or other member can be inserted, possibly into the ground, to hold the weight of the water inside of the structure.

The boards can have optional handles, indentations, grooves, holes, or apertures with which to facilitate ergonomic handling. Further, the boards can have an optional hole or other receptacle to which one or more tension members can optionally connect. The boards can include an optional supporting member that can optionally eliminate the need for some or all of the board holding members. There can optionally be included one or more clips, fasteners, U-clips, tapes, or other means for securing the liner to the boards, board holding members, or tension members (such as straps) of the rink.

The roughly rectangular rink can optionally have four roughly 90 degree corners, eight roughly 135 degree corners (to form a roughly octagonal rink perimeter shape), or some other combination. The corners can optionally include angled boards that cut off one or more corners of the rink to improve game flow on the rink. These corners of various angles can optionally be created by corner connectors similar to those in other embodiments, or by hinges, straps, or some other connection method.

There can optionally be one or more extension components to the boards, board holding members, such as nets that optionally attach netting or taller boards which optionally restrain pucks, players, or other objects within or outside the confines of the rink.

In one embodiment, the boards have two ends, one with an optional "male" connecting element such as a protuberance, and the other end with a "female" connecting element comprising one or more optional fingers and/or grooves, where the protuberance of the male connecting element of a side board interlocks (engages) with or slides into the female connecting element of an adjoining side board (the female connecting element receives the male connecting element) to form the perimeter of the rink. The female end of the board can optionally receive the male end in a vertical downward connecting movement. Alternatively, the male end of the board can optionally receive the female end in a vertically downward connecting movement.

The boards can be connected at the corners via a corner connector component which has a male connecting element comprising a protuberance and a female connecting element comprising a groove, where the male connecting element and the female connecting element are oriented at 90 degrees to one another or another selected angle, where the male connecting element of the corner connector interlocks (engages) with or slides into the female connecting element of a side board (the female connecting element of a side board receives the male connecting element of the corner connector) and the female connecting element of the corner connector interlocks (engages) with or receives the male connecting element (protuberance) of another side board to form a corner (or other angle) of the rink perimeter.

The present disclosure includes embodiments of an ice rink structure that is fast and easy to set up and take down. The rink can be assembled or installed on a variety of horizontal, flat, or semi-flat surfaces, including, but not limited to, grass, dirt, frozen ground, concrete, asphalt, or other paved or hard or soft surfaces. Unlike other products, the present invention and the preferred and alternative embodiments do not require staking into or penetrating the underlying surface. The present invention and the preferred and alternative embodiments solve this problem with a board holding member and strap (tension member) system which minimizes the risk of damage to the underlying surface(s) and/or buried utilities. The present invention and the preferred and alternative embodiments can be delivered in a self-contained kit with no additional tools or materials required for setup or takedown.

The side boards (panels) and board holding members allow for a variety of customizable sizes and configurations. The panels and board holding members are lightweight and strong. The tension members, such as a strap system, are convenient and eliminate the need for any tools or ground penetration. The liner receives the water and is optionally impermeable for longstanding use. The entire system allows for terrain differences (slope) of up to one foot or more across the area of the rink. The water self-levels due to gravity and optionally freezes into a flat ice surface.

The perimeter and tension member system allows the weight of the water on the one side of the perimeter component to be held up (supported/opposed) by the weight of the water on the opposing (or adjacent in some alternative embodiments) side of the perimeter component of the rink. The rink is self-standing and self-stabilizing. When the water freezes into ice, the weight of the ice on the tension member system and on the rink walls helps to lock the rink walls into place. The components of the rink can be stacked and stored in a compact area due to optional stacking nubs. The rink is lightweight which helps for shipping, handling, and storage. The rink is reusable, and can be used from one year to the next.

Further, in accordance with the present invention a method of constructing an ice rink structure is described, including steps of placing the board holding members on the perimeter of the rink, unrolling the tension members on the ground and attaching them to the board holding members, placing the boards in the board holding members, placing a water-impermeable liner over the area of the rink and over the top of the boards, securing the liner to the boards, filling the rink with water, and allowing it to freeze. The boards and board holding members can be combined into one component or installation step. In this case, the boards are laid on the perimeter and straps are attached directly to the boards.

The disclosed ice skating rink structure presents numerous benefits over those known in the art. The disclosed ice skating rink structure does not require penetration of the underlying surface so that it can be installed on any surface at any time of year, on frozen and thawed ground. The disclosed ice skating rink structure can be used on level ground, sloped ground, as well as bumpy ground. The disclosed ice skating rink structure can be installed and removed without causing great damage to the underlying surface. The disclosed ice skating rink structure can be re-used from season to season. The disclosed ice skating rink structure requires no tools for installation. The disclosed ice skating rink structure can be set up without penetrating the ground and requires no compression members such as lumber or heavy sand bags to hold the board holding members, boards or liner in place.

The disclosed ice skating rink structure can be modified for use on sloped lawns as opposed to flat hard surfaces and the water-impermeable liner can be oversized to allow for adjustment of the liner and modification of the rink structure's size and/or shape. The disclosed ice skating rink structure can easily be constructed using boards made from either plastic, lumber, plywood, carbon fiber, fiberglass, composite or some other synthetic or other material. The disclosed ice skating rink structure can include boards which are used to form the perimeter of the rink with no holes, grooves or other modifications such as incorporating plywood boards or other inserts to allow them to connect with the provided board holding members.

A more detailed explanation of the ice rink structure is provided in the following description and claims and is illustrated in the accompanying drawings.

DETAILED DESCRIPTION

Figure 1:
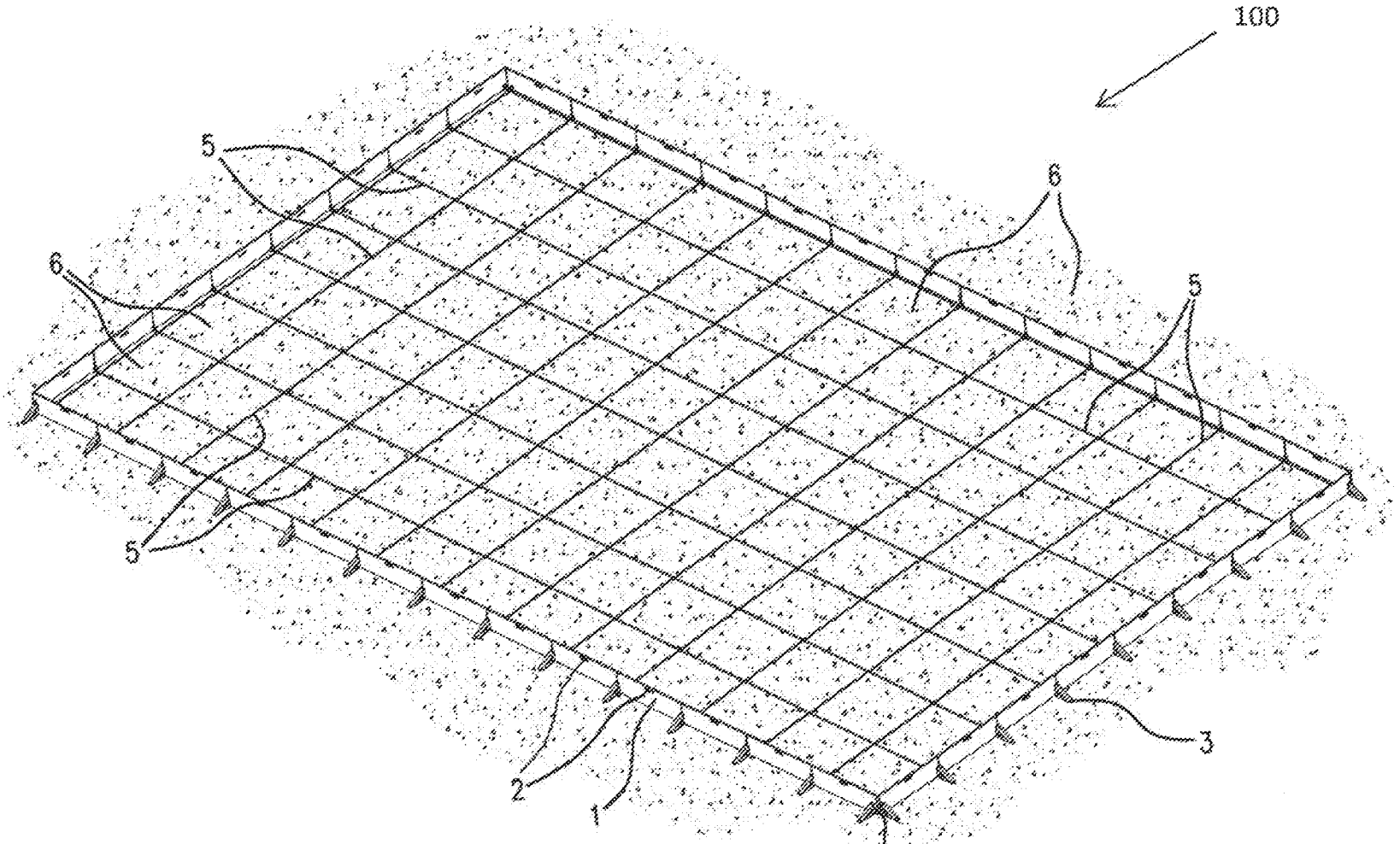
FIG. 1 is a perspective view of an ice skating rink structure according to the present disclosure with the impermeable liner and the water and/or ice omitted for clarity.
Figure 12:
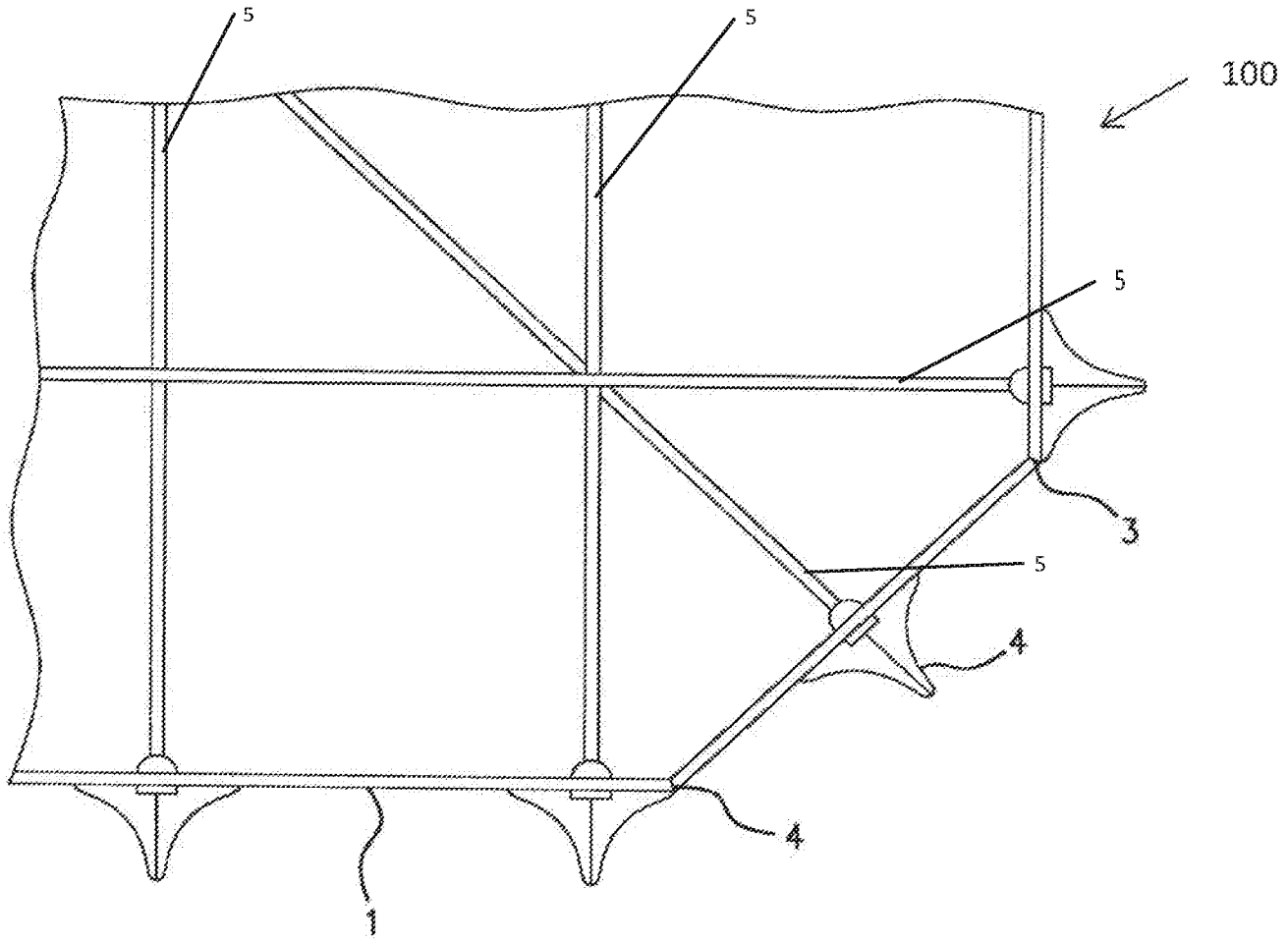
FIG. 12 is a partial plan view depicting an alternative embodiment of an ice skating rink structure according to the present disclosure with the impermeable liner and the water and/or ice omitted for clarity.

FIG. 1 depicts an assembled self-standing ice skating rink structure 100 of the present disclosure shown without the impermeable liner and without the water and/or ice. The ice skating rink structure 100 interlocking side boards 1, which, in some embodiments, are about 5 feet long, about 6 inches to 2 feet in height, and about 0.5 to 4 inches wide. In other embodiments, the boards have other dimensions. It should be noted that the side boards 1 are alternatively referred to as boards, panels, or side panels. In some embodiments, the side boards 1 are solid, hollow, or semi-hollow and include ridges or indentations on one or both sides to provide further structural integrity, strength, rigidity, and/or stability. In some embodiments, the side boards 1 include a side board aperture 2 (depicted in FIG. 1), which serve as a handle for transporting and positioning of the side board. In other embodiments, the side boards 1 include a permanently attached or detachable handle or an indentation under a groove that is formed into the side board or between two grooves that is formed into the side board to serve as a handle. FIG. 1 also depicts the board holding members 3. In the depicted embodiment, the board holding members 3 are each located at the junctions of the side boards 1 and near the corner edges of the side boards 1 at the corners of the ice skating rink structure 100. The depicted corner connecting components (or corner connectors) 4, each reversibly connect two adjacent side boards 1 to form a corner of the rink, and tension straps or tension members 5 secure the opposing side boards 1 of the assembled ice skating rink structure 100 a fixed distance from one another on the ground. The depicted tension members 5 traverse the length and width of the rink, directly contact the ground, run parallel to the side boards, and are positioned within the perimeter of the ice skating rink structure 100. In other embodiments, the tension members are mounted at a strap angle relative to the opposing side boards. FIG. 12 depicts an alternative embodiment in which some of the tension members 5 diagonally traverse the ice skating rink structure 100. In some embodiments, the board holding members are located at other positions on the side boards 1. The ice skating rink structure 100 depicted in FIG. 1 is installed on a horizontal surface 6. The depicted side boards 1 and corner connectors 4 define the perimeter of the ice skating rink structure 100.

Figure 2:
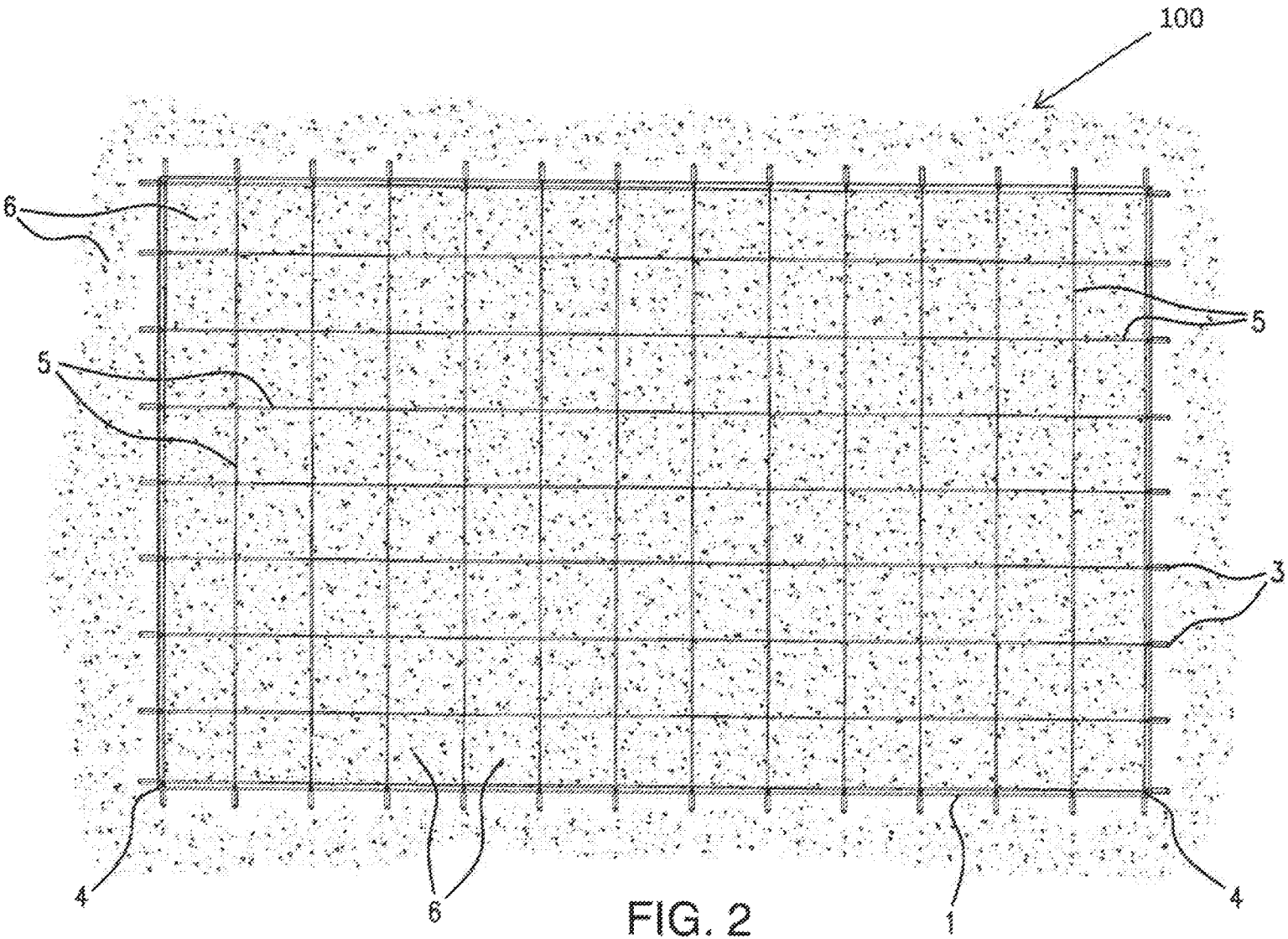
FIG. 2 is a plan view of the ice skating rink structure of FIG. 1.

Referring to FIG. 2, the interlocking side boards 1, the board holding members 3, and the corner connecting components 4 define the perimeter of the rink. Tension members 5 are secured to opposing side boards 1 of the assembled ice skating rink structure 100. A horizontal surface 6 is also illustrated.

Figure 3:
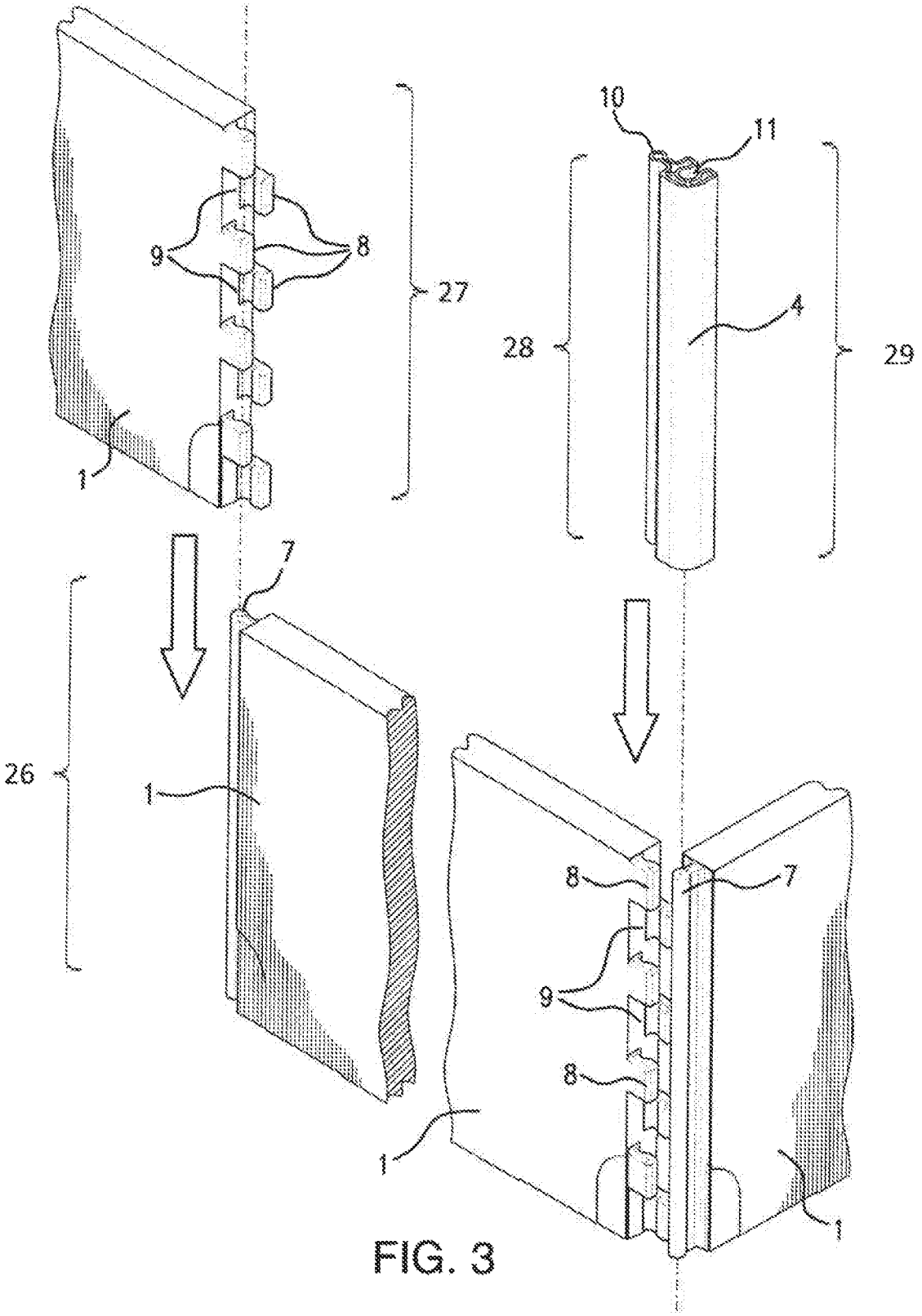
FIG. 3 is an exploded view depicting a portion of the side boards according to the present disclosure, including the corner connecting component.

Referring to FIG. 3, a male connecting element 26 of the side board 1 includes a protuberance 7 extending from one end of the side board, and a female connecting element 27 including fingers 8 and a groove 9 on the opposite end of the side board. The protuberance 7 of the male connecting element 26 of a side board interlocks (engages) with or slides into the female connecting element 27 of an adjoining side board (the female connecting element 27 receives the male connecting element 26) to form the sides of the perimeter of the rink. The depicted corner connecting component 4 has a male connecting element 28 comprising a protuberance 10 and a female connecting element 29 comprising a groove 11, where the protuberance 10 of the male connecting element 28 and the groove 11 of the female connecting element 29 are oriented at 90 degrees to each other. In some embodiments, the protuberance 10 of the male connecting element 28 and the groove 11 of the female connecting element 29 can be oriented at angles to each other than 90 degrees, e.g., 135 degrees. With respect to the corner connecting component 4, the male connecting element 28 of the corner connector 4 interlocks (engages) with or slides in to the female connecting element 27 of a side board (the female connecting element 27 of a side board 1 receives the male connecting element 27 of the corner connector 4) and the female connecting element 29 of the corner connector 4 interlocks (engages) with or receives the male connecting element 26 (protuberance 7) of another side board 1 to form a corner of the perimeter of the rink.

Figure 4:
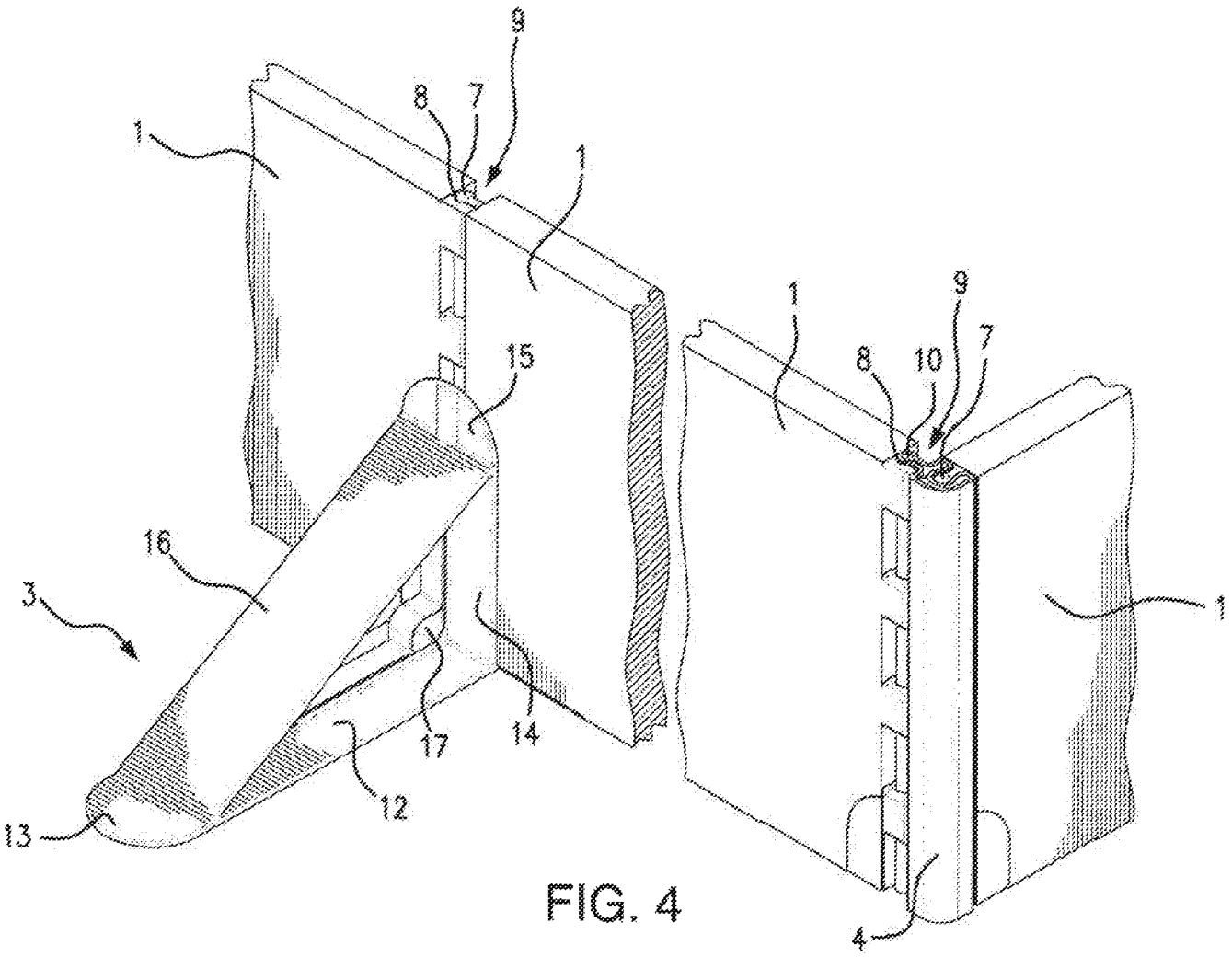
FIG. 4 is a partial perspective view of the side boards and corner connecting components of FIG. 3 in an assembled state including a board holding member.

Referring to FIG. 4, the side boards 1 are connected to each other and to the corner connecting component 4. The depicted side boards 1 slide into, i.e. are engaged with, and are supported by the board holding members 3. The depicted board holding members 3 include a base 12, an optional outer base extension 13, an outer vertical element 14, an optional extension of the outer vertical element 15, an optional supporting buttress 16, and an aperture (or loop or ring structure or receptacle or receiver) 17 for accepting and retaining the tension members 5. In other embodiments, the outer base extension 13 and/or the outer vertical element 15 are omitted. Further elements of the board holding members 3 are illustrated in FIGS. 5, 6, and 7.

Figure 5:
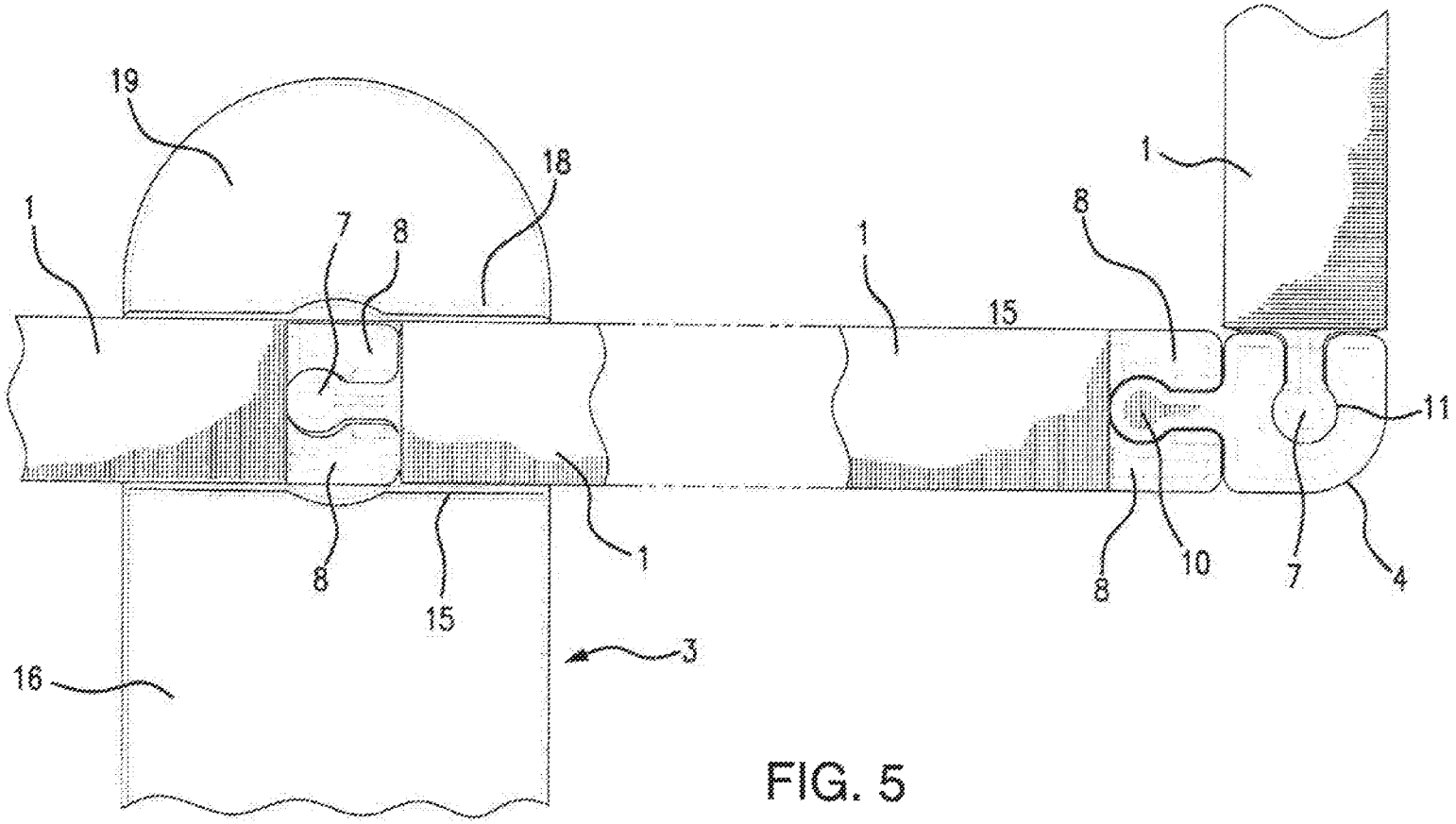
FIG. 5 is a partial plan view of the elements depicted in FIG. 4.

FIG. 5 depicts the connection between the side boards 1, the corner connecting component 4, and the board holding members 3 in greater detail. Specifically, the protuberance 10 of the corner connecting component 4 sliding into the fingers 8 of the side board 1, the groove 11 of the corner connector 4 engaging the sides of the protuberance 7 of the side board 1, the fingers 8 engage the sides of the protuberance 7 of the adjacent side boards 1, and the placement of the board holding member 3 between adjacent side boards 1. Also illustrated are the top surface of the optional outer vertical element 15 of the supporting bracket, the top surface of the supporting buttress 16 of the board holding member 3 (i.e., supporting bracket), the top surface of the inner vertical element 18 of the board holding member 3 (i.e., supporting bracket), and the top surface of the optional inner base extension 19 of the board holding member 3 (i.e., supporting bracket).

Figure 6:
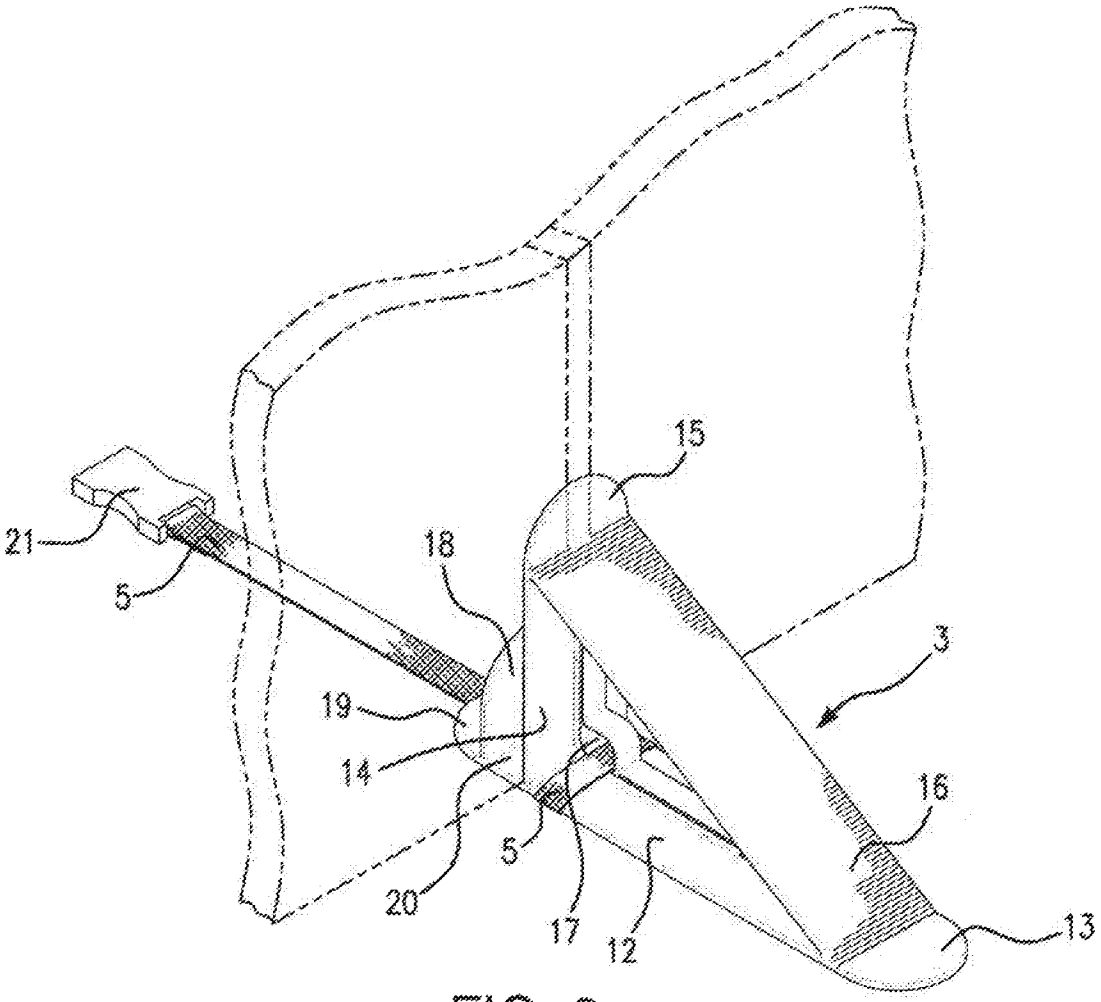
FIG. 6 is a perspective view depicting a board holding member according to the present disclosure and its engagement with the tension member with the remaining assembly shown in phantom for clarity.

FIG. 6 depicts the board holding member 3 and its engagement with the tension member 5. The side boards 1 are shown in phantom g to illustrate how they engage or slide into the board holding member 3. The depicted board holding member 3 also includes a base 12, an optional outer base extension 13, an outer vertical element 14, an optional extension of the outer vertical element 15, a supporting buttress 16, a foot 19, and an aperture 17 for accepting and retaining the tension member 5. An inner vertical element 18, the outer vertical element 14, and the base 12 define a slot 20. A connecting buckle is illustrated, which, in this embodiment, is a female connector portion 21 of the connecting buckle for engagement with a male connector portion 22 illustrated in FIG. 7, below.

Figure 7:
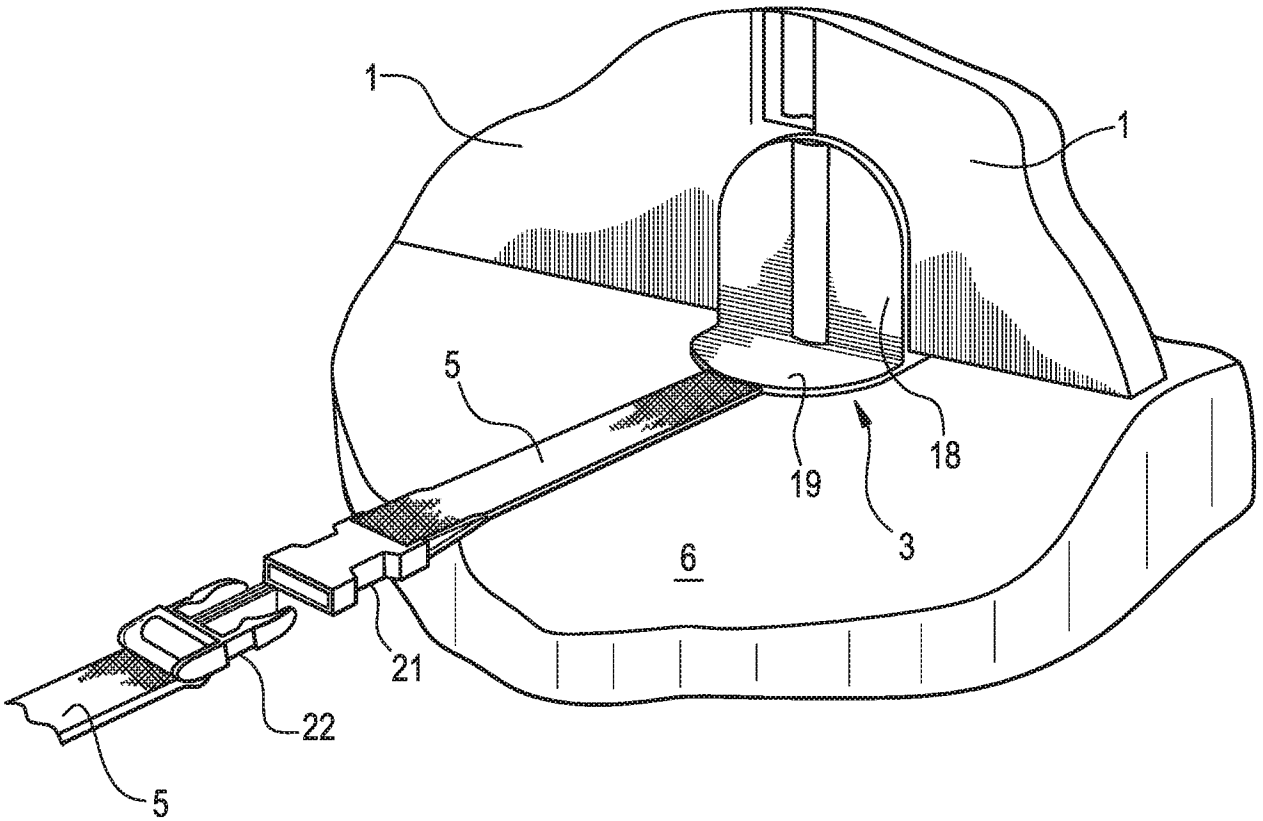
FIG. 7 is a perspective view from inside the rink depicting a board holding member according to the present disclosure and its engagement with side boards and a tension member.

FIG. 7 depicts the connection between the two portions of the tension member 5 and the board holding member 3 in greater detail. Both the female connector portion 21 and the male connector portion 22 of the tension member 3 are illustrated with the connector portions shown prior to engagement. The male connector portion 22 releasably mates with the female connector portion 21. In other embodiments, the connector portions 21, 22 are other adjustable, releasable, permanent or semi-permanent connectors. Also shown are the top surface of the inner vertical element 18 of the board holding member 3 (i.e., supporting bracket), and the top surface of the optional inner base extension 19 of the board holding member 3 (i.e., supporting bracket). The tension member 5 extends from the foot 19.

Figure 8:
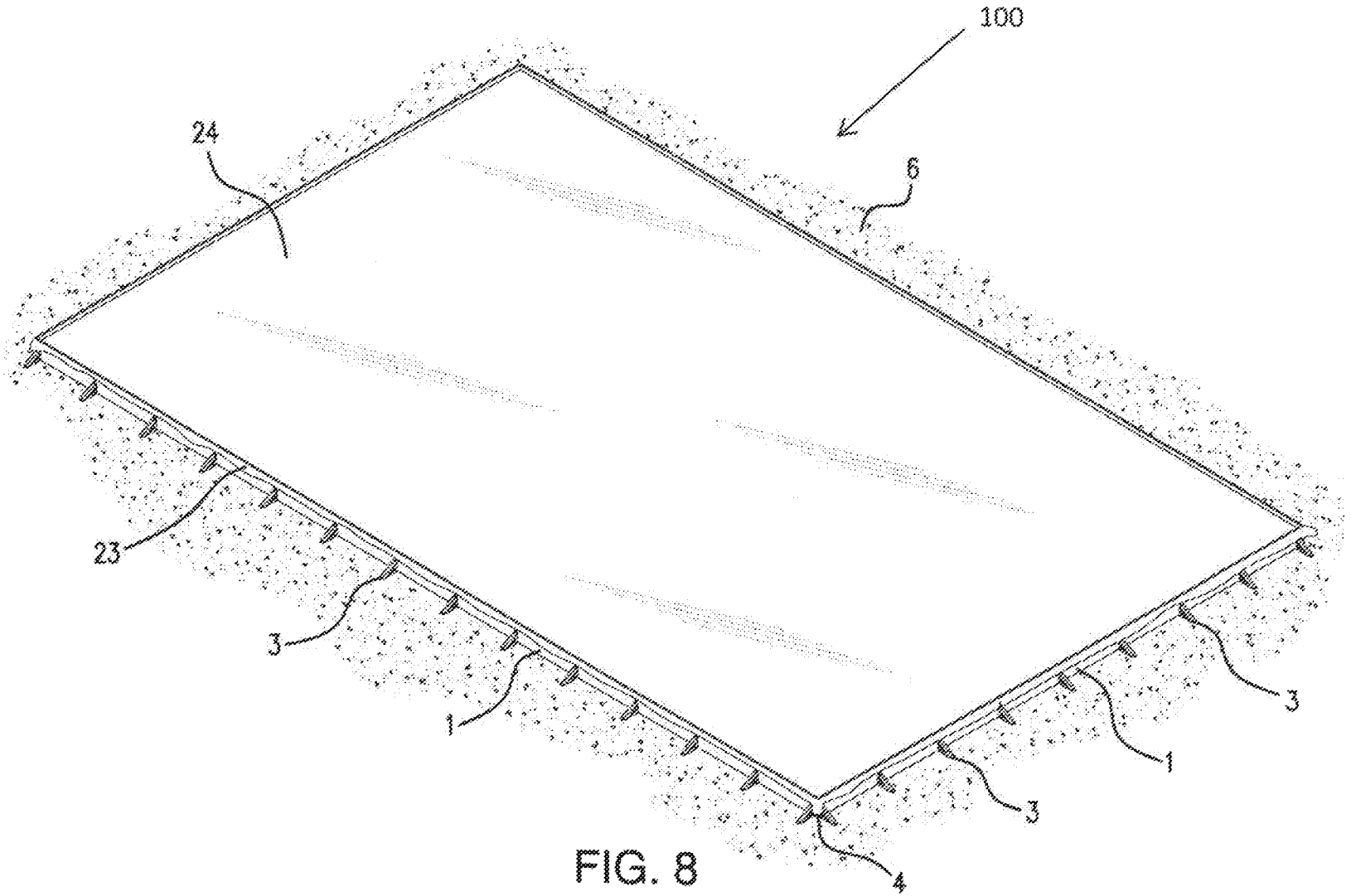
FIG. 8 is a perspective view from outside the rink of the ice skating rink structure of FIG. 1 including an impermeable liner and ice.

Referring to FIG. 8, an impermeable liner 23 is draped over the perimeter of the rink and water is frozen on the impermeable liner to form ice 24. The interlocking side boards 1, the board holding members 3, and the corner connectors 4 of the assembled ice skating rink structure 100 contain the water and allow it to freeze in place. In some embodiments, all or part of the water is poured into the impermeable liner before all of the aforementioned male connector portions are mated with the female connector portions. In the depicted embodiment, the impermeable liner 23 overlaps (e.g., excess or oversized liner hangs over) the side boards 1. A horizontal surface 6 is depicted beneath the ice rink. The boards and corner connectors define the perimeter of the rink. One benefit of the impermeable liner 23 overlapping the side boards 1 is that the shape of the impermeable liner 23 does not have to correspond to the shape of the perimeter of the rink. In some embodiments, the impermeable liner has a shape that is not complementary to the shape of the perimeter. In some embodiments, the impermeable liner is purposely larger than necessary to accommodate modification of the perimeter's shape and/or size.

Figure 9:
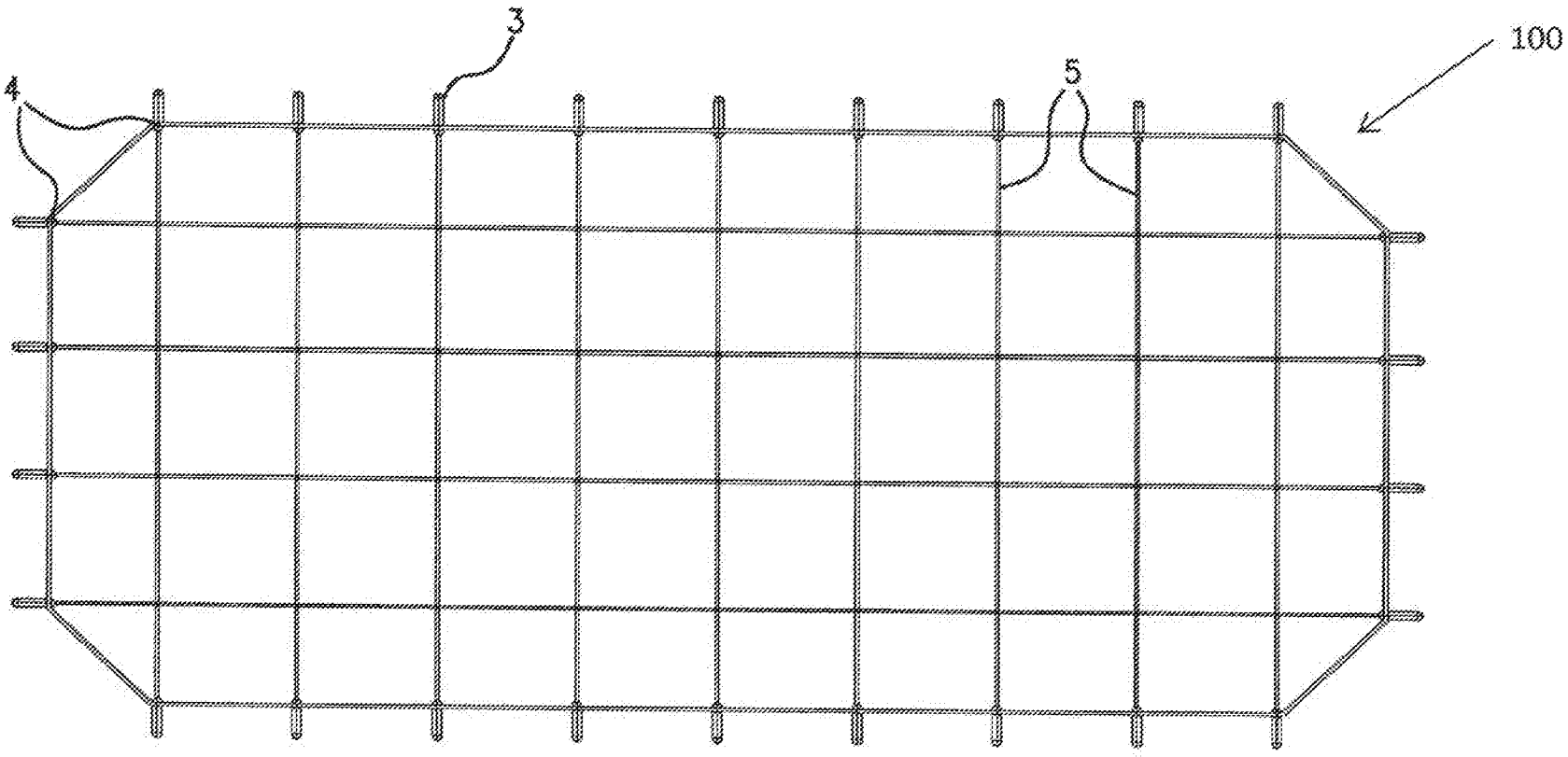
FIG. 9 is a plan view of an alternative embodiment of an ice skating rink structure according to the present disclosure with the impermeable liner and the water and/or ice omitted for clarity.

FIG. 9 depicts an alternative embodiment of the assembled self-standing ice skating rink structure 100 without the impermeable liner and without the water and/or ice. The perimeter defined by the interlocking side boards 1, the board holding members 3, corner connecting components 4, and tension members 5, secure the opposing side boards 1 of the four sides of the assembled ice skating rink structure 100. In this embodiment, an additional side board 1 is employed to form an interlocking corner, at 135 degrees to the adjacent sides. In some embodiments, the corners are formed at other angles.

Figure 10:
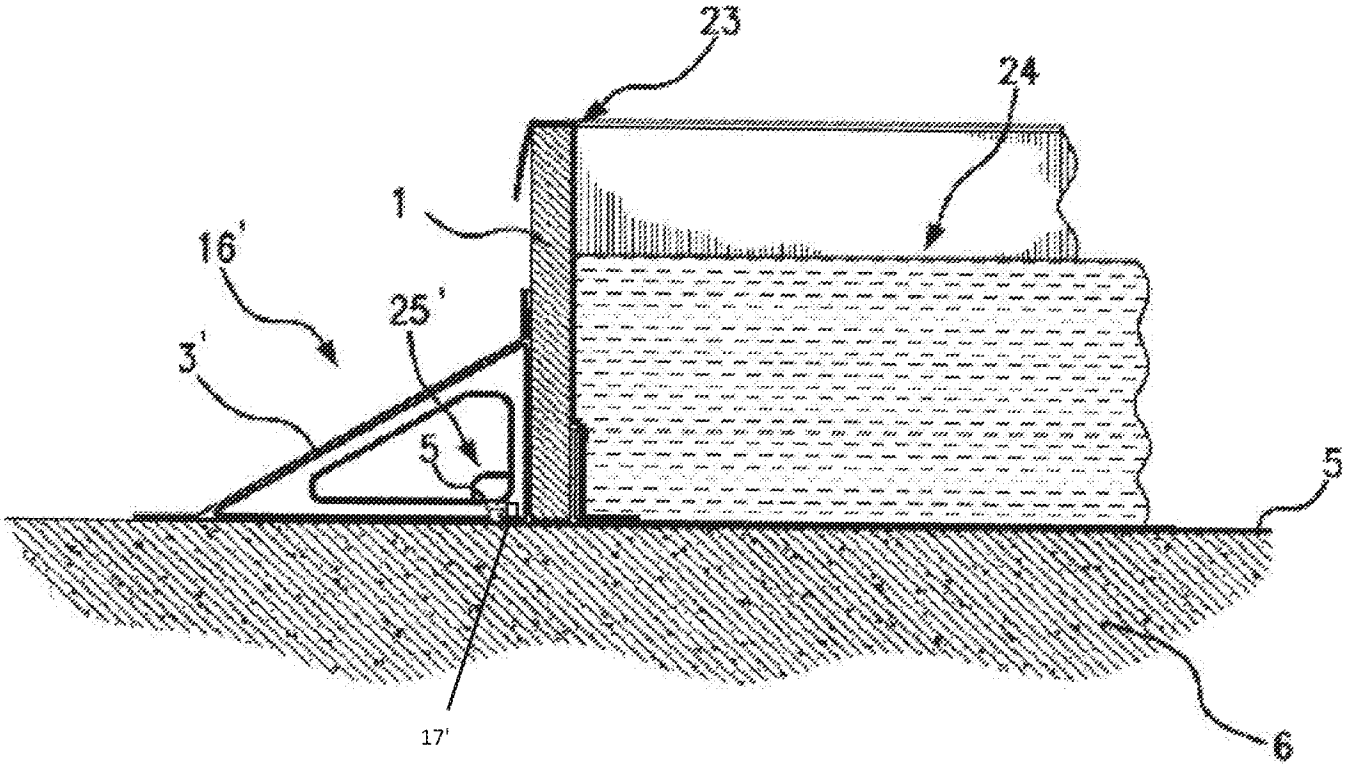
FIG. 10 is a side cutaway view of an alternative embodiment of a board holding member and side board according to the present disclosure.

FIG. 10 depicts an alternative embodiment of a board holding member 3' vertically supporting a side board 1. The water impermeable liner 23 is laid over the board and the tension member 5 is attached with clip 25' to the bottom of the board holding member 3'. In an alternative embodiment, the board holding member and board are a single piece. The depicted board holding member 3' includes an optional supporting buttress 16'. In the depicted embodiment, the weight of the ice 24 on the tension member 5 and side board 1 helps to stabilize the side board 1.

Figure 11A:
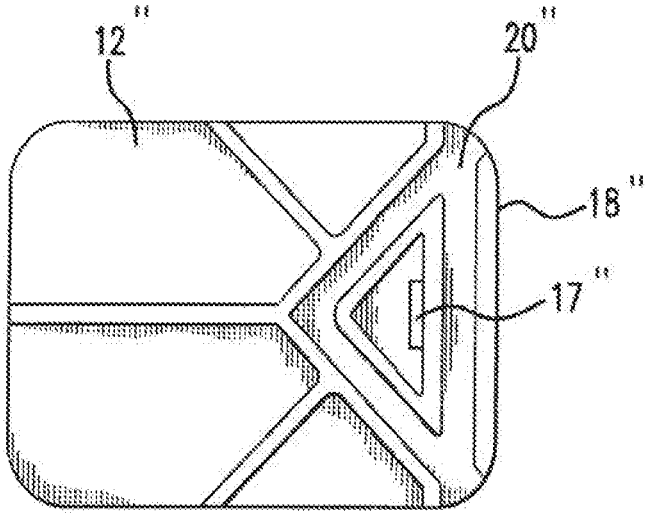
FIG. 11A is a plan view of an alternative embodiment of a board holding member according to the present disclosure.
Figure 11B:
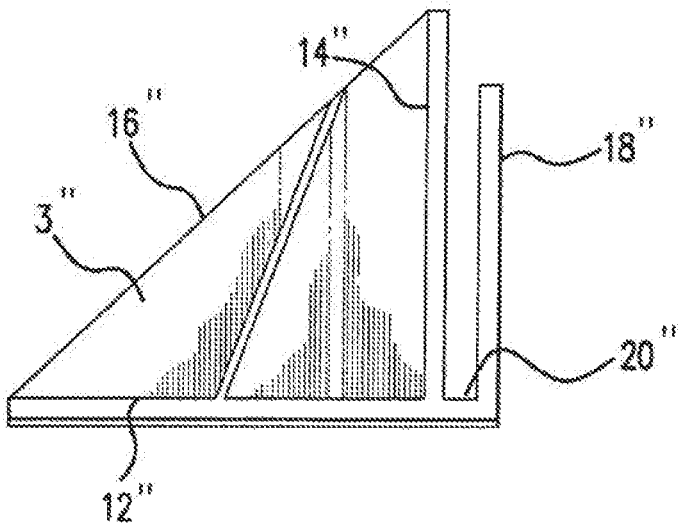
FIG. 11B is a cross sectional view of the board holding member of FIG. 11A.

FIGS. 11A and 11B depict an alternative embodiment for the board holding member 3". The board holding member 3" allows the boards to attach or connect at an angle of 90 degrees relative to one another. In other embodiments, this angle is straight (180 degrees) or at some other angle, for example 22.5, 45, 112.5, or 135 degrees. In some embodiments, the board holding member 3" includes slots 20" at different orientations. The depicted board holding member 3" comprises a base 12", an inner vertical element 18", an outer vertical element 14", a supporting buttress 16", and an aperture 17" (depicted in FIG. 11A) for accepting and retaining the tension members, which are not shown.

Referring to FIG. 12, an alternative embodiment of the assembled self-standing ice skating rink structure 100 includes side boards 1 forming the corner interlock at an angle other than 90 degrees. In this embodiment, the boards interlock at 135-degrees. In the depicted embodiment, the tension members 5 are oriented diagonally across the rink when corner connectors 4 other than 90 degrees are used. In some embodiments, other variations on orientation of the straps in such a rink, such as in FIG. 9, are included.

Figure 13:
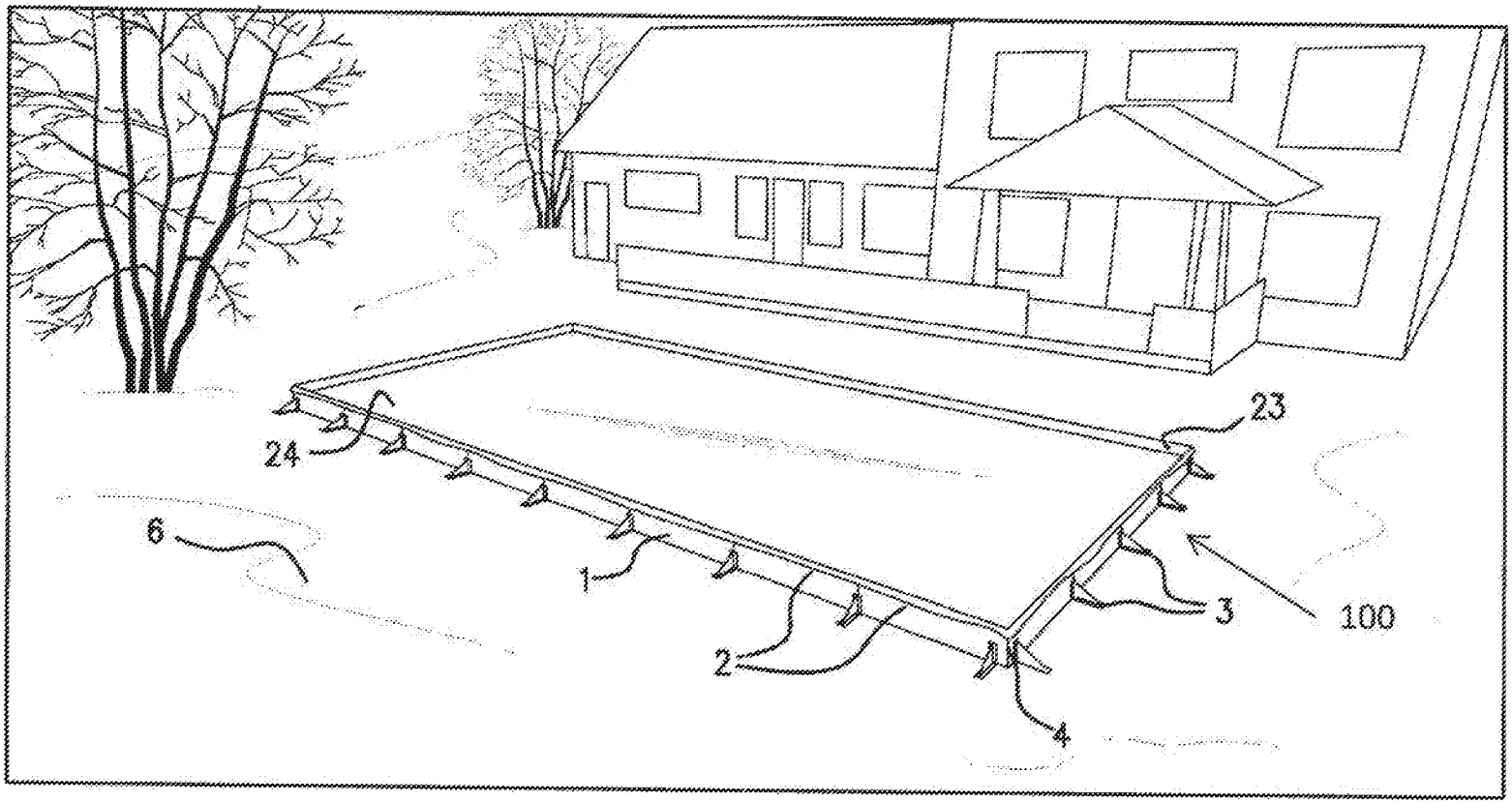
FIG. 13 is an isometric view of an ice skating rink structure according to the present disclosure installed on a residential lot.

FIG. 13 depicts one embodiment of the ice skating rink structure 100 of the present disclosure including ice on a residential lot. The side boards 1, board holding members 3, and corner connecting elements 4 define the perimeter of the rink installed on a horizontal surface (the ground) 6.

Figure 14:
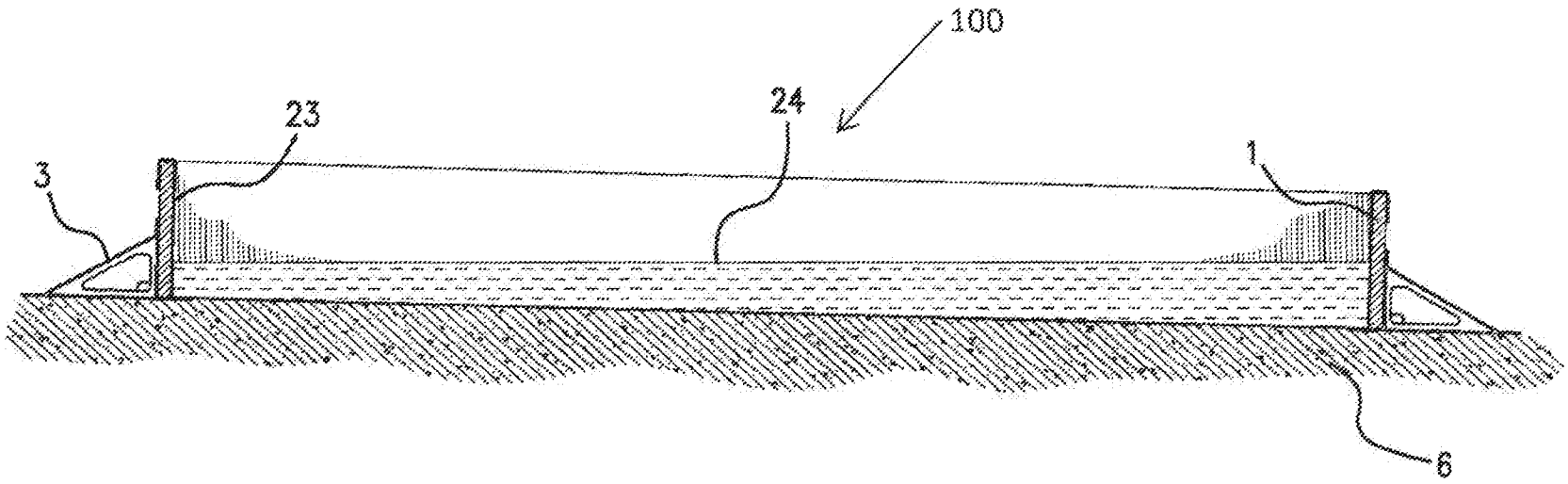
FIG. 14 is a cross sectional view of an ice skating rink structure according to the present disclosure including water that self-levels when installed on a semi-flat or sloping surface.
Figure 15:
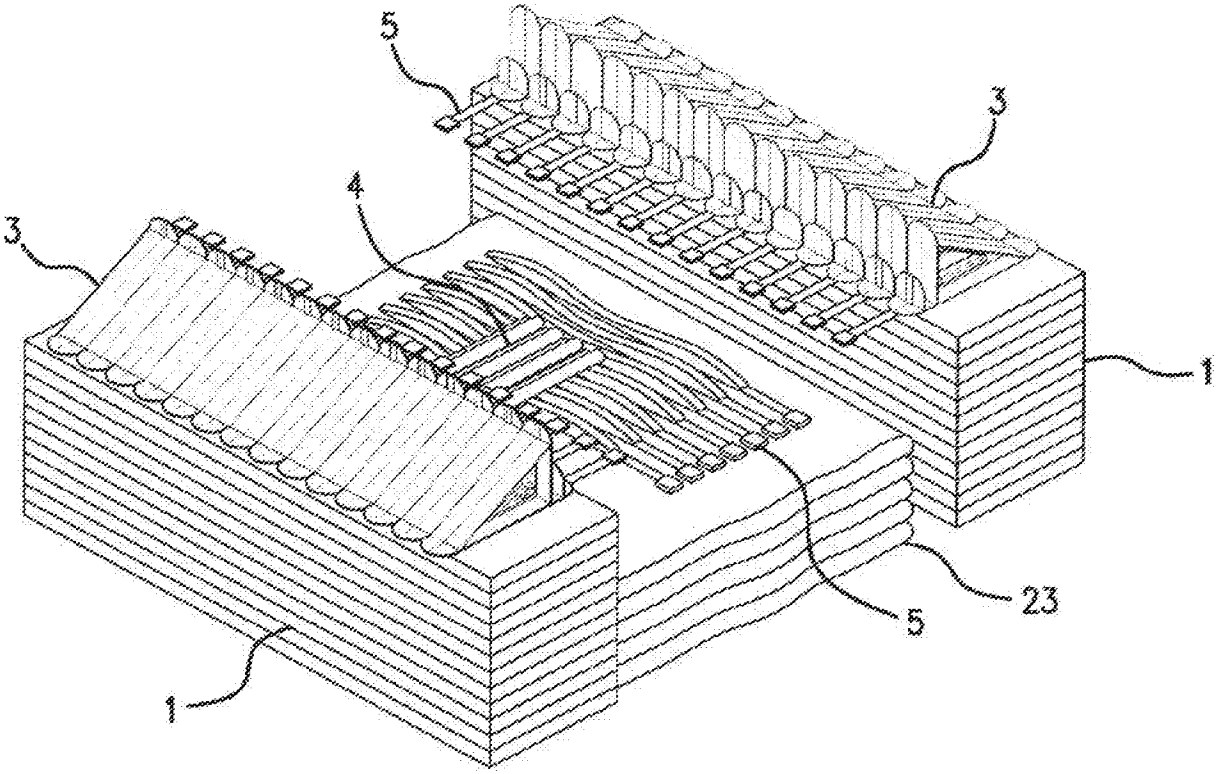
FIG. 15 depicts the components of an ice skating rink structure according to the present disclosure disassembled and stacked in a compact orientation.

Referring to FIG. 14, the water self-levels when installed on a semi-flat or sloping horizontal surface 6. The resulting ice 24 naturally forms the desired horizontal surface. Referring to FIG. 15, the components of the self-standing ice skating rink structure of the present invention. The depicted components are grouped as a kit.

In some embodiments, an ice skating rink structure disclosed herein includes one or more tension members and a perimeter component. These tension members act to hold the rink structure together. The perimeter component includes one or more side boards 1. The rink includes one or more board holding members. These board holding members can be spaced in between the boards or behind them and can be the supports that help keep the boards in a generally vertical orientation.

In some embodiments, the self-standing ice skating rink structure disclosed herein includes one or more, or alternatively a plurality, of tension members; a water-impermeable liner; and a perimeter component.

In some embodiments, the perimeter component includes a plurality of interlocking side boards.

In some embodiments the perimeter component is a single side board that is bendable upon itself and interlocks with itself to define the enclosure of the rink.

In some embodiments, the perimeter component includes one or more corner connecting components.

In some embodiments, the corner connecting components are adjustable to define a corner of a target angle. By a target angle is meant the desired angle that is sought for each corner of the rink. For example, for an essentially rectangular rink, the corner angles, i.e. four in this case, would each be about 90 degrees. In other embodiments, other target angles are selected. For example in a rink with "cut-off" corners such that the rink has an octagonal shape, the corner angles, i.e. eight in this case, would each be 135 degrees.

In some embodiments, the corner connecting components include an adjustable means such that the corner connecting components are adjustable to define a corner of a target angle.

In some embodiments, the adjustable means is a hinge. In some embodiments, the adjustable hinge is attached to one or more side boards.

In some embodiments, the rink structure includes a plurality of board holding members.

In some embodiments, each of said interlocking side boards comprises one or more integrated board holding members.

In some embodiments, the self-standing ice skating rink structure includes a plurality of tension members; a plurality of board holding members; a water-impermeable liner; and a perimeter component, comprising a plurality of interlocking side boards and one or more corner connecting components.

In some embodiments, the rink structure is positioned on an essentially horizontal surface. It is to be appreciated that the rink structure does not appreciate penetrate or insert into the essentially horizontal surface.

In some embodiments, the perimeter component defines an essentially rectangular, an essentially oval, or an essentially octagonal geometric shape wherein the interlocking side boards are connected with each other to form opposing side walls and where the side walls are connected to each other with four corner connecting components to form the corners of the rectangular geometric shape.

In some embodiments, the board holding member includes a flat base having an inner end and an outer end, an outer vertical element perpendicular to the base located a fixed distance from the outer end of the base, an inner vertical element perpendicular to the base and separated from and parallel to the outer vertical element and located a fixed distance from the inner end of the base or at the inner end of the base. The outer vertical element, inner vertical element and the intervening portion of the base define a U-shaped slot. A supporting buttress is connected to the outer surface of the outer vertical element and connected to the base a fixed distance from the outer end of the base or at the outer end of the base. The supporting buttress, outer vertical element, and the portion of the base between the outer vertical element and the supporting buttress define an essentially rectangular geometric shape, and a receiver oriented on the base and on the outer side of the squared cornered U-shaped slot for receiving the tension member.

In some embodiments, each board holding member is oriented such that the inner end of the base is directed to the interior of the essentially rectangular geometric shape of the rink and each side board is removeably and vertically engaged in the squared cornered U-shaped slot of the board holding member.

In some embodiments, a board holding member is positioned wherein each side board is connected to each other.

In some embodiments, an additional board holding member is positioned adjacent to where a side board is connected to a corner connecting component.

In some embodiments, the rink structure has an even number of board holding members, and the board holding members are oriented in opposing pairs directly across from each other.

In some embodiments, each of the tension members provides a tension traveling roughly perpendicular to the perimeter component and the tension members travel across the area of said rink and in contact with the horizontal surface and attach to the perimeter component on the opposite side of said rink.

In some embodiments, each tension member is connected to a pair of opposing board holding members.

In some embodiments, the tension member is connected to the board holding member via the receiver of the board holding member.

In some embodiments, the receiver is an aperture through which the tension member passes through and is removeably or permanently attached.

In some embodiments, the tension members are selected from cables, straps, wires or belts.

In some embodiments, the tension members comprise an attachable/detachable connecting means.

In some embodiments, the tension member is a strap or belt and the attachable/detachable connecting means is a buckle.

In some embodiments, each side board includes a first end and a second end. The first end includes a male connecting component and the second end includes a female connecting component.

In some embodiments, the male connecting component includes a protuberance and the female connecting component includes a plurality of fingers and a groove.

In some embodiments, the corner connector includes a male connecting component and a female connecting component oriented at a defined angle to each other, other than 180 degrees.

In some embodiments, the angle is 90 degrees.

In some embodiments, the male connecting component of the corner connector is a protuberance and the female connecting component of the corner connector is a groove.

In an aspect the present invention relates to a rink structure wherein the impermeable liner is oriented within the perimeter, in contact with the horizontal surface, on top of the tension members, and draped over the perimeter. The impermeable liner overlaps the side boards and the shape of the impermeable liner does not have to correspond to the shape of the perimeter of the rink. In some embodiments, the impermeable liner has a shape that is not complementary to the shape of the perimeter. In some embodiments, the impermeable liner is purposely larger than necessary to accommodate modification of the perimeter's shape and/or size.

In some embodiments, the rink structure includes a plurality of clips, such as for example U-clips, for removeably securing the impermeable liner to the side boards of the perimeter.

In some embodiments, each side board includes a handle.

In some embodiments, the handle is an aperture.

In some embodiments, the handle is a groove running parallel to the length of the side board.

In some embodiments, water or ice is contained within the impermeable liner.

In some embodiments, the rink rests on an underlying essentially horizontal surface without penetrating the surface.

In some embodiments, the rink requires no tools or hardware for assembly (or installation).

In some embodiments, the rink can be assembled (or installed) in about 60 minutes or less.

In some embodiments, the portable, self-standing ice skating rink structure, includes: one or more tension members, a plurality of board holding members, a water-impermeable liner, and a perimeter component, comprising a plurality of side boards.

In some embodiments, the portable, self-standing ice skating rink structure, including: one or more tension members; a water-impermeable liner; and a perimeter component. The perimeter component is made up of a plurality of interlocking side boards and one or more corner connecting components.

In some embodiments, a method of assembling a portable, self-standing ice skating rink structure, from a kit including: a plurality of tension members; a plurality of board holding members; a water-impermeable liner; and a perimeter component, comprising a plurality of interlocking side boards and one or more corner connecting components is disclosed herein.

In some embodiments, a method includes filling the water-impermeable liner with water, and allowing the water to freeze within the liner.

In some embodiments, a kit for constructing a portable self-standing ice skating rink structure as described herein and includes any combination of the recited components and variants thereof.

In some embodiments, an ice skating rink structure, includes one or more tension members and a perimeter component.

In some embodiments, the perimeter component includes one or more boards.

In some embodiments, the rink includes one or more board holding members.

In some embodiments, the rink includes an impermeable liner.

In some embodiments, the tension members are hoop or circumference stresses, oriented around the perimeter component.

In some embodiments, each of the board holding members has at least one support to hold one or more of said boards.

In some embodiments, each of the tension members provides a tension traveling roughly perpendicular to the perimeter component and the tension members travel across the area of the rink and attaches to the perimeter component on the opposite side of the rink.

In some embodiments, the tension members attach one or more of said board holding members together.

In some embodiments, said tension members are non-permanently attached to said board holding members.

In some embodiments, said tension members are permanently attached to said board holding members.

In some embodiments, said tension members are non-permanently attached to said boards.

In some embodiments, said tension members are permanently attached to said boards.

In some embodiments, said tension members are composed of a material selected from rubber, fabric, rope, elastic material, metal, carbon fiber, wood, composites, or a combination thereof.

In some embodiments, said rink comprises an impermeable liner.

In some embodiments, said tension members are under the liner.

In some embodiments, said tension members are above the liner.

In some embodiments, said tension members travel through said liner.

In some embodiments, said liner acts as said tension members.

In some embodiments, said tension members are attached to the bottom of said liner.

In some embodiments, said tension members are attached to the top of said liner.

In some embodiments, said tension members are woven through one or more boards.

In some embodiments, said tension members are attached at an angle other than perpendicular to said perimeter component.

In some embodiments, said board holding members are non-permanently attached to said boards.

In some embodiments, said board holding members are permanently attached to said boards.

In some embodiments, said board holding members hold said boards in an upright position without attaching to the boards.

In some embodiments, said board holding members hold said boards together without attaching to the boards.

In some embodiments, said board holding members are continuous with said boards.

In some embodiments, board holding members are designed with a roughly perpendicular member to brace said boards against the ground.

In some embodiments, said board holding members are weighted.

In some embodiments, said board holding members attach to said boards beneath said boards.

In some embodiments, said board holding members attach to said boards above said boards.

In some embodiments, said board holding members attach to said boards between said boards.

In some embodiments, said board holding members attach to said boards through slots or holes in said boards.

In some embodiments, said board holding members attach to said boards by fully surrounding a portion of said boards.

In some embodiments, said liner travels over said boards and attaches to said board holding members.

In some embodiments, said liner travels beneath said boards and attaches to said board holding members.

In some embodiments, said liner attaches to said boards.

In some embodiments, said rink optionally comprises one or more board holding members which are staked into the ground.

In some embodiments, one or more of said boards has a curved cross-sectional profile.

In some embodiments, said boards have adjustable heights.

In some embodiments, said boards are non-permanently attached to one another.

In some embodiments, said boards are permanently attached to one another.

In some embodiments, said liner is temporarily water permeable.

In some embodiments, said liner is refrigerated.

In some embodiments, said liner is manufactured for use without ice and compatible with wheeled objects.

In some embodiments, said liner is removable.

In some embodiments, said liner is disposable.

In some embodiments, said board holding members hold one or more boards.

In some embodiments, said board holding members hold said boards at an angle formed between contiguous boards other than 180 degrees.

In some embodiments, said boards are attached to each other by hinges.

In some embodiments, said board holding members are attached to said boards by hinges.

In some embodiments, said boards act as said tension members.

In some embodiments, one or more of said tension members are not under tension.

In some embodiments, said boards form the perimeter of the ice rink.

In some embodiments, said tension members attach to the bottom of said board holding members.

In some embodiments, said tension members attach to the top of said board holding members.

In some embodiments, said tension members attach to the back of said board holding members.

In some embodiments, said tension members attach to the front of said board holding members.

In some embodiments, said tension members attach through said board holding members.

In some embodiments, said board holding members have a slot, clip, or other member with which to hold the board.

In some embodiments, said boards overlap each other.

In some embodiments, said tension members are unrolled with an unrolling mechanism.

In some embodiments, said boards connect to one another and can pivot to form an acute, obtuse, straight, reflex or right angle.

In some embodiments, said board holding members twist and lock into said boards.

In some embodiments, said tension members twist and lock into said board holding members.

In some embodiments, said tension members twist and lock into said boards.

In some embodiments, said water impermeable liner is oriented within the perimeter of said rink.

In some embodiments, said perimeter component is held in an upright and generally perpendicular position with respect to the ground.

In some embodiments, said perimeter component defines a rink selected from rectangular, rectangular with curved corners, rectangular with straight cut-off angled corners, circular, or oval in shape.

In some embodiments, said perimeter component comprises at least two or more boards oriented at opposing sides of the rink.

In some embodiments, there is more than one of said board holding members per respective board.

In some embodiments, one or more of said boards is self-standing.

In some embodiments, said rink is portable.

In some embodiments, said rink is self-standing.

In some embodiments, said rink rests on an underlying surface without penetrating said underlying surface.

In some embodiments, said rink is portable and self-standing.

In some embodiments, said rink requires no tools or hardware for installation.

In some embodiments a method of constructing an ice skating rink structure includes the steps of: providing a perimeter component; providing and attaching one or more tension members to said perimeter component; providing a water impermeable liner within said perimeter component; filling said liner with water, and allowing said water to freeze within said liner.

In some embodiments of the method, the perimeter component includes one or more board holding members and one or more boards.

In some embodiments, the method also includes the steps of attaching one or more board holding members to one or more boards in an alternating fashion to form the perimeter component.

The ice skating rink structure's tension members can act as hoop or circumference stresses, and can be oriented inside, outside or around the perimeter component. Each of said board holding members can have at least one support to hold one or more of said boards. Each tension member can provide a tension traveling roughly perpendicular to said perimeter components and the tension members can travel across the area of the rink and attach to the perimeter component on the opposite side of the rink.

Each tension member can attach one or more of said board holding members together. Each tension member can be permanently or non-permanently attached to said board holding members. These tension members can be permanently or non-permanently attached to the boards. The tension members are composed of a material selected from rubber, fabric, rope, elastic material, metal, carbon fiber, wood, composites, or a combination thereof.

The tension members can lie under or above the liner or can travel through the liner. The liner can act as said tension members. The tension members can be attached to the top or bottom of the liner for convenience of installation or some other purpose. The tension members can also be woven through one or more boards. The tension members can be attached at an angle other than perpendicular to said perimeter component.

The board holding members can be permanently or non-permanently attached to said boards. The board holding members can hold said boards in an upright position with or without attaching to the boards. The board holding members can hold said boards together with or without attaching to the boards. The board holding members can be continuous with the boards. The board holding members can be designed with a roughly perpendicular member to brace said boards against the ground. The board holding members can be weighted.

The board holding members can attach to said boards beneath, above or between the boards. The board holding members can attach to said boards by passing through slots or holes in the boards or by fully surrounding a portion of the boards.

The liner can travel over, beneath or through said boards and attach to said board holding members or the back side of the board. The liner can attach to said boards either above or below them.

The rink can optionally comprise one or more board holding members which are staked into the ground. This option is primarily for rinks on sloped ground. One or more of said boards can have a curved cross-sectional profile. The boards can have adjustable heights. The boards can be permanently or non-permanently attached to one another.

The liner can be temporarily water permeable to assist in removal of rink. The liner can be refrigerated to enhance ice formation and/or retention. The liner can be manufactured for use without ice such that it is compatible with wheeled objects, for example roller skates, skateboards or other devices. The liner can be removable and/or disposable.

The board holding members can hold one or more boards and can hold them at 180 degrees or any other angle including, but not limited to, acute, right, obtuse or reflex. The boards can be attached to each other by hinges. The board holding members can be attached to said boards by hinges. The boards can act as said tension members. All tension members must not always be under tension. Said boards can form the perimeter of the ice rink. Said tension members can attach to the bottom, top, back, or front of said board holding members. The tension members can attach through said board holding members.

The board holding members can have a slot, clip, or other member with which to hold the board. Said boards can overlap each other. The tension members can be unrolled with an unrolling mechanism. The boards can connect to one another and can pivot to form an acute, obtuse, straight, reflex or right angle.

The board holding members can twist and lock into said boards. For example, there can be a male and female end which attach or clip together. The tension members can twist and lock into said board holding members. The tension members can twist and lock into said boards.

The water impermeable liner can be oriented within the perimeter of the rink. The perimeter component can be held in an upright and generally perpendicular position with respect to the ground. The perimeter component can define a rink selected from rectangular, rectangular with curved corners, circular or oval in shape. The perimeter component can comprise at least two or more boards oriented at opposing sides of the rink. There can be more than one of said board holding members per respective board. One or more of said boards can be self-standing.

The ice skating rink structure can be one or more of the following: portable, self-standing, rest on an underlying surface without penetrating said underlying surface. The rink can require no tools or hardware for installation.

To install the rink, set up the perimeter component, attach tension members to said perimeter component, lay a water impermeable liner within said perimeter component, fill the liner with water, and allow water to freeze into ice. The perimeter component can comprise one or more board holding members and/or one or more boards. These board holding members and boards can interlock in an alternating fashion.

It is therefore an object of the present disclosure to provide an ice skating rink structure that is easy and quick to construct.

It is another object of the present disclosure to provide an ice skating rink structure that does not require penetration of the underlying surface so that it can be installed on any surface at any time of year.

It is a further object of the present disclosure to provide an ice skating rink structure that can be used on level ground, sloped ground, as well as bumpy ground.

It is another object of the present disclosure to provide an ice skating rink structure that can be installed and removed without causing great damage to the underlying surface.

It is another object of the present disclosure to provide an ice skating rink structure that can be re-used from season to season.

It is another object of the present disclosure to provide an ice skating rink structure that requires no tools for installation.

It is another object of the present disclosure to provide an ice skating rink structure that can be set up without penetrating the ground and also requires no compression members such as lumber or heavy sand bags to hold the board holding members, boards or liner in place.

It is another object of the present disclosure to provide an ice skating rink structure that can be modified for use on sloped lawns as opposed to flat hard surfaces.

It is another object of the present disclosure to provide an ice skating rink structure which can easily be constructed using boards made from either plastic, lumber, plywood, carbon fiber, fiberglass, composite or some other synthetic or other material.

It is another object of the present disclosure to provide an ice skating rink structure such that the boards which are used to form the perimeter of the rink require no holes, grooves or other modifications to allow them to connect with the provided board holding members.

Other objects and advantages of the present disclosure will become apparent as the description proceeds.

The disclosure is not limited to the foregoing illustrative examples and the examples should be considered in all respects as illustrative and not restrictive, reference being made to the appended claims, rather than to the foregoing examples, and all changes which come within the meaning and range of equivalency of the claims are therefore intended to be embraced.

The entire disclosure of each of the patent documents, including certificates of correction, patent application documents, scientific articles, governmental reports, websites, and other references referred to herein is incorporated by reference herein in its entirety for all purposes. In case of a conflict in terminology, the present specification controls.

The disclosure can be embodied in other specific forms without departing from the spirit or essential characteristics thereof. The foregoing embodiments are to be considered in all respects illustrative rather than limiting on the invention described herein. In the various embodiments of the present disclosure, where the term comprises is used, it is also contemplated that the embodiments consist essentially of, or consist of, the recited steps or components. Furthermore, the order of steps or the order for performing certain actions is immaterial as long as the invention remains operable. Moreover, two or more steps or actions can be conducted simultaneously.

In the specification, the singular forms also include the plural forms, unless the context clearly dictates otherwise. Unless defined otherwise, all technical and scientific terms used herein have the same meaning as commonly understood by one of ordinary skill in the art to which this invention belongs. In the case of conflict, the present specification will control.

What is claimed is:

1. A kit for constructing a self-standing ice skating rink structure, the kit comprising:

side boards configured to collectively define an area, each of the side boards extending from a first end defined by a connection element to a second end defined by a complementary connection element;

board holding members each configured to releasably secure at least a portion of at least one of the side boards to hold the at least one of the side boards in a vertical orientation; and tension members each configured to be attached to at least one of the board holding members and to traverse the area, wherein at least one of the board holding members comprises a receptacle, and at least one of the tension members is configured to be attached to the receptacle.

2. The kit according to claim 1, wherein the connection element and the complementary connection element are disposed at an angle relative to one another to define a corner.

3. The kit according to claim 2, wherein the angle is adjustable.

4. The kit according to claim 1, wherein the side boards are further configured to interlock by the connection element and the complementary connection element.

5. The kit according to claim 4, wherein each of the tension members is further configured to be removably connected to a pair of opposing board holding members of the board holding members.

6. The kit according to claim 1, further comprising corner connecting components configured to connect adjacent side boards of the side boards at an angle, wherein the corner connecting components comprise an adjustable means for adjusting the angle.

7. The kit according to claim 6, wherein the adjustable means is a hinge.

8. The kit according to claim 1, wherein at least one of the board holding members is integrally formed with the at least one of the side boards.

9. The kit according to claim 1, further comprising corner connecting components configured to engage adjacent side boards of the side boards to define the area, wherein the side boards are further configured to connect to one another using the connection element and the complementary connection element.

10. The kit according to claim 1, further comprising a water impermeable liner configured to be placed on top of the tension members and draped over the side boards.

11. The kit according to claim 10, wherein the side boards are further configured to form a size or a shape that is different from a size or a shape of the impermeable liner.

12. The kit according to claim 10, further comprising a plurality of clips configured to removably secure the impermeable liner to the side boards.

13. The kit according to claim 1, wherein the ice skating rink structure is positioned on a horizontal surface without penetrating the horizontal surface.

14. The kit according to claim 1, wherein the side boards are further configured to form an essentially rectangular, an essentially oval, or an essentially octagonal geometric shape, the side boards are further configured to be connected with each other to form opposing side walls, and the side walls are configured to be connected to each other with four or more corner connecting components to form corners of the geometric shape.

15. The kit according to claim 1, wherein the board holding members each comprise a flat base having an inner end and an outer end, an outer vertical element perpendicular to the base and located a fixed distance from the outer end of the base, and an inner vertical element perpendicular to the base and separated from and parallel to the outer vertical element and located a fixed distance from the inner end of the base or at the inner end of the base, the outer vertical element, the inner vertical element and an intervening portion of the base define a U-shaped slot, a supporting buttress is connected to an outer surface of the outer vertical element and connected to the base at a fixed distance from the outer end of the base or at the outer end of the base, the base, the supporting buttress, and the outer vertical element define an essentially rectangular geometric shape, and the receptacle is a receiver positioned on the base and on an outer side of the U-shaped slot for receiving the at least one of the tension members.

16. The kit according to claim 15, wherein each of the board holding members is further configured to be oriented such that the inner end of the base is directed to an interior of the essentially rectangular geometric shape, and each of the side boards is configured to be removably and vertically engaged in the U-shaped slot.

17. The kit according to claim 1, wherein a board holding member of the board holding members is positioned at a connection between one of the side boards and a corner connecting component.

18. The kit according to claim 1, wherein each of the tension members is further configured to provide a tension traveling roughly perpendicular to two pairs of the side boards on opposite sides of the rink structure, traverse the area so as to be in contact with a horizontal surface, and attach to the two pairs of the side boards.

19. The kit according to claim 1, wherein each of the tension members is further configured to be removably connected to a pair of opposing board holding members of the board holding members.

20. The kit according to claim 1, wherein the connection element is a male connecting component defined by a protuberance and the complementary connection element is a female connecting component defined by a plurality of fingers and a groove.

21. The kit according to claim 1, wherein each side board of the side boards comprises a handle.

22. The kit according to claim 21, wherein the handle is defined by at least one of an aperture and a groove running parallel to a length of the respective side board of the side boards.

23. The kit according to claim 1, wherein the receptacle is an aperture, the at least one of the tension members is configured to extend through the respective aperture, and engage a respective locking mechanism to fix the at least one of the tension members to a respective board holding member of board holding members.

24. The kit according to claim 23, wherein the locking mechanism is configured to fix a respective tension member of the at least one of the tension members within the aperture, and the locking mechanism is defined by twisting the at least one of the tension members within the aperture.

25. The kit according to claim 24, wherein the locking mechanism is defined by twisting the at least one of the tension members within the aperture.

26. The kit according to claim 1, wherein the receptacle is an aperture.

27. The kit according to claim 1, wherein the side boards are further configured to form a perimeter of the ice-skating rink structure.

28. The kit according to claim 1, wherein the receptacle is a receiver configured to receive the at least one of the tension members.

29. The kit according to claim 1, wherein at least one of the board holding members comprises a board holding receptacle, and at least one of the side boards is configured to be removably held in the board holding receptacle.

30. The kit according to claim 1, wherein the receptacle is one of respective receptacles of the board holding members, and each of the tension members is configured to be attached to two of the respective receptacles such that the tension members form a grid pattern in the area.

31. The kit according to claim 1, wherein at least one of the side boards comprises a supporting member.

32. The kit according to claim 1, wherein the side boards are integrally formed with the board holding members.

33. The kit according to claim 1, wherein the side boards comprise a board that is bendable to define the area.

34. The kit according to claim 1, further comprising a water impermeable liner configured to be in communication with the side boards, wherein the liner comprises the tension members.

35. The kit according to claim 1, further comprising a water impermeable liner configured to be in communication with the side boards, wherein the tension members travel through the liner.

36. The kit according to claim 1, wherein the side boards are configured to be arranged to allow ice to form in the area such that the ice is enclosed by the side boards.

37. The kit according to claim 1, wherein the side boards are further configured to define an enclosure of the ice skating rink structure, wherein at least a portion of the side boards are walls.

38. A method of assembling a self-standing ice skating rink structure, the method comprising:

providing side boards, each of the side boards extending from a first end defined by a connection element to a second end defined by a complementary connection element;

providing board holding members, and positioning the side boards in relation to the board holding members such that the board holding members each releasably secure at least a portion of at least one of the side boards to hold the at least one of the side boards in a vertical orientation and such that the side boards collectively define an area, wherein at least one of the board holding members comprises a receptacle; and providing tension members, and attaching each of the tension members to at least one of the board holding members such that the tension members traverse the area and at least one of the tension members is attached to the receptacle.

39. The method according to claim 38, further comprising:

draping a water-impermeable liner over the tension members and the side boards.

40. The method according to claim 39, further comprising:

filling the water-impermeable liner with water; and allowing the water to freeze within the liner.

41. The method according to claim 39, wherein the positioning of the side boards comprises assembling the side boards to form a shape or a size that is different from a shape or a size of the water-impermeable liner.

42. The method according to claim 41, further comprising changing the size and/or the shape formed by the side boards before the draping of the water-impermeable liner over the tension members and the side boards.

43. The method according to claim 38, further comprising:

filling the area with water; and allowing the water to freeze within the area.

44. The method according to claim 38, wherein the side boards define an enclosure of the rink structure, wherein at least a portion of the side boards are walls.

45. A kit for constructing a self-standing ice skating rink structure, the kit comprising:

side boards configured to collectively define an area within the ice skating rink structure, each of the side boards extending from a first end defined by a connection element to a second end defined by a complementary connection element;

board holding members each configured to releasably secure at least a portion of at least one of the side boards to hold the at least one of the side boards in a vertical orientation; and tension members each configured to be attached to at least one of the board holding members and to traverse the area, wherein at least one of the board holding members comprises a receptacle, and at least one of the tension members is configured to be attached to the receptacle.

46. The kit according to claim 45, further comprising at least one corner connecting component having a first corner-connection element and a second corner-connection element disposed at an angle relative to one another to define a corner.

47. The kit according to claim 46, wherein the angle is adjustable.

48. The kit according to claim 46, wherein the at least one corner connecting component comprises an adjustment means configured to adjust the angle.

49. The kit according to claim 48, wherein the adjustment means comprises a hinge configured to be releasably attached to a portion of the side boards.

50. The kit according to claim 46, wherein the side boards are further configured to connect to one another using the connection element and the complementary connection element, and the first corner-connection element and the second corner-connection element are each configured to engage adjacent ones of the side boards to define a perimeter.

51. The kit according to claim 46, wherein at least one of the board holding members is configured to be positioned at a connection between one of the side boards and the at least one corner connecting component.

52. The kit according to claim 45, wherein the side boards are further configured to interlock.

53. The kit according to claim 45, wherein the side boards and the board holding members are integrally formed.

54. The kit according to claim 45, further comprising a water impermeable liner configured to be placed on top of the tension members and draped over the side boards.

55. The kit according to claim 54, wherein the side boards are further configured to form a size or a shape that is different from a size or a shape of the impermeable liner.

56. The kit according to claim 54, further comprising a plurality of clips configured to removably secure the impermeable liner to the side boards.

57. The kit according to claim 45, wherein the ice skating rink structure is positioned on a horizontal surface such that the ice skating rink structure does not penetrate the horizontal surface.

58. The kit according to claim 45, wherein the side boards are further configured to form an essentially rectangular, an essentially oval, or an essentially octagonal geometric shape, the side boards are further configured to be connected with each other to form opposing side walls, and the side walls are configured to be connected to each other with four or more corner connecting components to form corners of the geometric shape.

59. The kit according to claim 45, wherein the board holding members each comprise a flat base having an inner end and an outer end, an outer vertical element perpendicular to the base and located a fixed distance from the outer end of the base, and an inner vertical element perpendicular to the base and separated from and parallel to the outer vertical element and located a fixed distance from the inner end of the base or at the inner end of the base, the outer vertical element, the inner vertical element and an intervening portion of the base define a U-shaped slot, a supporting buttress is connected to an outer surface of the outer vertical element and connected to the base at a fixed distance from the outer end of the base or at the outer end of the base, and the base, the supporting buttress, and the outer vertical element define an essentially rectangular geometric shape.

60. The kit according to claim 59, wherein each of the board holding members is further configured to be oriented such that the inner end of the base is directed inwardly into the area, and each of the side boards is further configured to be removably engaged in the board holding member.

61. The kit according to claim 45, wherein each of the tension members is further configured to provide a tension traveling roughly perpendicular to two pairs of the side boards on opposite sides of the ice skating rink structure, traverse the area of the ice skating rink structure so as to be in contact with a horizontal surface, and attach to the two pairs of the side boards.

62. The kit according to claim 45, wherein at least one of the tension members is configured to be removably connected to a pair of opposing board holding members of the board holding members.

63. The kit according to claim 45, wherein the receptacle is one of respective receptacles of the board holding members, and each of the tension members is configured to be attached to two of the respective receptacles such that the tension members form a grid pattern in the area.

64. The kit according to claim 45, wherein the connection element is a male connecting component defined by a protuberance and the complementary connection element is a female connecting component defined by a plurality of fingers and a groove.

65. The kit according to claim 45, wherein at least one of the side boards comprises a handle.

66. The kit according to claim 65, wherein the handle is defined by at least one of an aperture and a groove running parallel to a length of the respective side board of the side boards.

67. The kit according to claim 45, wherein the receptacle is an aperture, at least one of the tension members is configured to extend through the aperture and engage a respective locking mechanism to fix the at least one of the tension members to a respective board holding member of the board holding members, and the locking mechanism is configured to fix a respective tension member of the at least one tension member within the aperture.

68. The kit according to claim 67, wherein the locking mechanism is defined by twisting the at least one of the one or more tension members within the aperture.

69. The kit according to claim 68, wherein the locking mechanism is defined by twisting the at least one of the tension members within the aperture.

70. The kit according to claim 45, wherein the receptacle is an aperture.

71. The kit according to claim 45, wherein the side boards are further configured to form a perimeter of the ice skating rink structure.

72. A portable, self-standing ice skating rink structure, comprising:

a perimeter component defining an area; and one or more tension members connected to the perimeter component and travelling across the area, wherein the perimeter component comprises a plurality of side boards, wherein each of the plurality of side boards extends from a first end defined by a connection element to a second end defined by a complementary connection element, wherein at least one of the one or more tension members extends through an aperture in one of the plurality of side boards, wherein the at least one of the one or more tension members engages a locking mechanism to fix the at least one of the one or more tension members to the one of the plurality of side boards, and wherein the locking mechanism fixes the at least one of the one or more tension members within the aperture.

73. The portable, self-standing ice skating rink structure according to claim 72, wherein the locking mechanism comprises a twist in the connection member.

74. A portable, self-standing ice skating rink structure, comprising:

a perimeter component defining an area;

one or more tension members connected to the perimeter component and travelling across the area; and a plurality of board holding members configured to releasably secure at least a portion of the perimeter component, wherein the perimeter component comprises a plurality of side boards, wherein each of the plurality of side boards extends from a first end defined by a connection element to a second end defined by a complementary connection element, wherein at least one of the one or more tension members extends through an aperture in one of the plurality of board holding members, wherein the at least one of the one or more tension members engages a locking mechanism to fix the at least one of the one or more tension members to the one of the plurality of board holding members, and wherein the locking mechanism fixes the at least one of the one or more tension members within the aperture.

75. The portable, self-standing ice skating rink structure according to claim 74, wherein the locking mechanism comprises a connection buckle.

76. A portable, self-standing ice skating rink structure, comprising:

a perimeter component defining an area;

one or more tension members connected to the perimeter component and travelling across the area; and a plurality of board holding members configured to releasably secure at least a portion of the perimeter component, wherein the perimeter component comprises a plurality of side boards, wherein each of the plurality of side boards extends from a first end defined by a connection element to a second end defined by a complementary connection element, wherein at least one of the plurality of board holding members comprises a receptacle, and wherein at least one of the one or more tension members is attached to the receptacle.

77. The portable, self-standing ice skating rink structure according to claim 76, wherein each of the plurality of side boards is a rectangular wall.

78. The portable, self-standing ice skating rink structure according to claim 76, wherein each of the plurality of board holding members comprises a base, a buttress, and an outer vertical element, the buttress extends from the base, the outer vertical element extends from the base, the buttress extends from the base to the outer vertical element, and the outer vertical element is perpendicular to the base such that the base, the buttress, and the outer vertical element form a right triangle.

79. The portable, self-standing ice skating rink structure according to claim 78, wherein the receptacle is an opening formed in an interior of the triangle by material that extends from the base to the outer vertical element.

80. The portable, self-standing ice skating rink structure according to claim 79, wherein each of the plurality of board holding members further comprises a foot extending from an intersection of the base and the outer vertical element in a direction parallel to the base.

81. The portable, self-standing ice skating rink structure according to claim 80, wherein each of the board holding members further comprises an inner vertical element extending from the foot in a direction parallel to the outer vertical element to form a slot configured to releasably secure the portion of the perimeter component such that the inner vertical element is on one side of the perimeter component and within the area and the outer vertical element is on another side of the perimeter component and outside of the area.

82. The portable, self-standing ice skating rink structure according to claim 81, wherein a tension member of the one or more tension members extends from the foot.

83. The portable, self-standing ice skating rink structure according to claim 82, wherein each of the one or more tension members is a strap.

84. The portable, self-standing ice skating rink structure according to claim 76, wherein each of the plurality of board holding members comprises a foot positioned in the area, and at least one of the one or more tension members extends from the foot.

85. The portable, self-standing ice skating rink structure according to claim 76, wherein the receptacle is an opening formed at a respective corner of the at least one of the plurality of board holding members.

86. The portable, self-standing ice skating rink structure according to claim 76, wherein the plurality of side boards are releasably connectable to each other by the connection element and the complementary connection element.

87. The portable, self-standing ice skating rink structure according to claim 76, further comprising a corner connector having a protuberance and a groove, wherein the corner connector is configured to join with a first side board of the plurality of side boards and a second side board of the plurality of side boards such that the first side board forms a right angle with the second side board, the connection element of the first side board engages the protuberance, and the complementary connection element of the second side board engages the groove.

88. The portable, self-standing ice skating rink structure according to claim 87, wherein the connection element of the first side board comprises fingers, and the complementary connection element of the second side board comprises another protuberance.

89. The portable, self-standing ice skating rink structure according to claim 76, wherein each of the one or more tension members is a strap.

90. A portable, self-standing ice skating rink structure, comprising:

a perimeter component defining an area;

one or more tension members connected to the perimeter component and travelling across the area; and a plurality of board holding members configured to releasably secure at least a portion of the perimeter component, wherein the perimeter component comprises a plurality of side boards, wherein each of the plurality of side boards extends from a first end defined by a connection element to a second end defined by a complementary connection element, wherein at least one of the plurality of side boards comprises a receptacle, and wherein at least one of the one or more tension members is attached to the receptacle.

91. The portable, self-standing ice skating rink structure according to claim 90, wherein the receptacle is an opening.

92. A portable, self-standing ice skating rink structure, comprising:

a perimeter component defining an area within the rink structure; and one or more tension members connected to the perimeter component, wherein the perimeter component comprises a plurality of side boards, wherein each of the plurality of side boards extends from a first end defined by a first connection element to a second end defined by a second connection element, wherein at least one of the one or more tension members extends through an aperture in one of the plurality of side boards, wherein the at least one of the one or more tension members engages a locking mechanism to fix the at least one of the one or more tension members to the one of the plurality of side boards, and wherein the locking mechanism fixes the at least one of the one or more tension members within the aperture.

93. The portable, self-standing ice skating rink structure according to claim 92, wherein the locking mechanism comprises a male connector.

94. A portable, self-standing ice skating rink structure, comprising:

a perimeter component defining an area within the rink; and one or more tension members connected to the perimeter component;

wherein the perimeter component comprises a plurality of side boards, and wherein each of the plurality of side boards extends from a first end defined by a connection element to a second end defined by a second connection element;

a plurality of board holding members configured to releasably secure at least a portion of the perimeter component, wherein at least one of the tension members extends through an aperture in one of the plurality of board holding members, and at least one of the tension members engages a locking mechanism to fix at least one of the tension members to the one of the plurality of board holding members, and wherein the locking mechanism fixes the at least one of the tension members within the aperture.

95. The portable, self-standing ice skating rink structure according to claim 94, wherein the locking mechanism comprises a female connector.

96. A kit for constructing a portable, self-standing ice skating rink structure, the kit comprising:

a perimeter component configured to define an area; and one or more tension members configured to be connected to the perimeter component and to travel across the area, wherein the perimeter component comprises a plurality of side boards, wherein each of the plurality of side boards extends from a first end defined by a connection element to a second end defined by a complementary connection element, wherein at least one of the one or more tension members is configured to extend through an aperture in one of the plurality of side boards, wherein the at least one of the one or more tension members is configured to engage a locking mechanism to fix the at least one of the one or more tension members to the one of the plurality of side boards, and wherein the locking mechanism is configured to fix the at least one of the one or more tension members within the aperture.

97. A kit for constructing a portable, self-standing ice skating rink structure, the kit comprising:

a perimeter component configured to define an area;

one or more tension members configured to be connected to the perimeter component and to travel across the area; and a plurality of board holding members configured to releasably secure at least a portion of the perimeter component, wherein the perimeter component comprises a plurality of side boards, wherein each of the plurality of side boards extends from a first end defined by a connection element to a second end defined by a complementary connection element, wherein at least one of the one or more tension members is configured to extend through an aperture in one of the plurality of board holding members, wherein the at least one of the one or more tension members is configured to engage a locking mechanism to fix the at least one of the one or more tension members to the one of the plurality of board holding members, and wherein the locking mechanism is configured to fix the at least one of the one or more tension members within the aperture.

98. A kit for constructing a portable, self-standing ice skating rink structure, the kit comprising:

a perimeter component configured to define an area;

one or more tension members configured to be connected to the perimeter component and to travel across the area; and a plurality of board holding members configured to releasably secure at least a portion of the perimeter component, wherein the perimeter component comprises a plurality of side boards, wherein each of the plurality of side boards extends from a first end defined by a connection element to a second end defined by a complementary connection element, wherein at least one of the plurality of board holding members comprises a receptacle, and wherein at least one of the one or more tension members is configured to be attached to the receptacle.

99. A kit for constructing a portable, self-standing ice skating rink structure, the kit comprising:

a perimeter component configured to define an area;

one or more tension members configured to be connected to the perimeter component and to travel across the area; and a plurality of board holding members configured to releasably secure at least a portion of the perimeter component, wherein the perimeter component comprises a plurality of side boards, wherein each of the plurality of side boards extends from a first end defined by a connection element to a second end defined by a complementary connection element, wherein at least one of the plurality of side boards comprises a receptacle, and wherein at least one of the one or more tension members is configured to be attached to the receptacle.

100. A kit for constructing a portable, self-standing ice skating rink structure, the kit comprising:

a perimeter component configured to define an area within the rink structure; and one or more tension members configured to be connected to the perimeter component, wherein the perimeter component comprises a plurality of side boards, wherein each of the plurality of side boards extends from a first end defined by a first connection element to a second end defined by a second connection element, wherein at least one of the one or more tension members is configured to extend through an aperture in one of the plurality of side boards, wherein the at least one of the one or more tension members is configured to engage a locking mechanism to fix the at least one of the one or more tension members to the one of the plurality of side boards, and wherein the locking mechanism is configured to fix the at least one of the one or more tension members within the aperture.

101. A kit for constructing a portable, self-standing ice skating rink structure, the kit comprising:

a perimeter component configured to define an area within the rink structure;

one or more tension members configured to be connected to the perimeter component; and a plurality of board holding members configured to releasably secure at least a portion of the perimeter component, wherein the perimeter component comprises a plurality of side boards, wherein each of the plurality of side boards extends from a first end defined by a first connection element to a second end defined by a second connection element, wherein at least one of the one or more tension members is configured to extend through an aperture in one of the plurality of board holding members, wherein the at least one of the one or more tension members is configured to engage a locking mechanism to fix the at least one of the one or more tension members to the one of the plurality of board holding members, and wherein the locking mechanism is configured to fix the at least one of the one or more tension members within the aperture.

102. A portable, self-standing ice skating rink structure, comprising:

side boards configured to collectively define an area, each of the side boards extending from a first end defined by a connection element to a second end defined by a complementary connection element;

board holding members each configured to releasably secure at least a portion of at least one of the side boards to hold the at least one of the side boards in a vertical orientation; and tension members each configured to be attached to at least one of the board holding members and to traverse the area, wherein at least one of the board holding members comprises a receptacle, and at least one of the tension members is configured to be attached to the receptacle.

103. A portable, self-standing ice skating rink structure, comprising:

side boards configured to collectively define an area within the ice skating rink, each of the side boards extending from a first end defined by a connection element to a second end defined by a complementary connection element;

board holding members each configured to releasably secure at least a portion of at least one of the side boards to hold the at least one of the side boards in a vertical orientation; and tension members each configured to be attached to at least one of the board holding members and to traverse the area, wherein at least one of the board holding members comprises a receptacle, and at least one of the tension members is configured to be attached to the receptacle.

104. A kit for constructing a self-standing ice skating rink structure, the kit comprising:

side boards configured to collectively define an area;

board holding members each configured to secure at least a portion of at least one of the side boards to hold the at least one of the side boards in a vertical orientation; and tension members each configured to be attached to at least one of the board holding members and to traverse the area, wherein at least one of the board holding members comprises a receptacle, and at least one of the tension members is configured to be attached to the receptacle, and wherein each of the side boards extends from a first end defined by a connection element comprising a first flat surface to a second end defined by a complementary connection element comprising a second flat surface.

105. The kit according to claim 104, wherein the first flat surface is a first flat end surface configured to abut a flat end surface of an adjacent side board of the side boards, and the second flat surface is a second flat end surface configured to abut another flat end surface of another adjacent side board of the side boards.

106. The kit according to claim 104, wherein the board holding members are each configured to releasably secure the at least the portion of the at least one of the side boards.

* * * * *